US008859172B2

(12) United States Patent
Nagasaka et al.

(10) Patent No.: US 8,859,172 B2
(45) **Date of Patent: *Oct. 14, 2014**

(54) ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC APPARATUS

(75) Inventors: Hideaki Nagasaka, Suntou-gun (JP); Masaki Nonaka, Suntou-gun (JP); Masato Tanaka, Tagata-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/477,561

(22) Filed: May 22, 2012

(65) Prior Publication Data

US 2013/0137021 A1 May 30, 2013

(30) Foreign Application Priority Data

Nov. 30, 2011 (JP) ..... 2011-262122
Apr. 26, 2012 (JP) ..... 2012-100968

(51) Int. Cl.
*G03G 5/047* (2006.01)

(52) U.S. Cl.
USPC ..... 430/58.05

(58) Field of Classification Search
USPC ..... 430/58.05
See application file for complete search history.

(56) References Cited

U.S. PATENT DOCUMENTS

| | | | | |
|---|---|---|---|---|
| 4,444,863 | A | 4/1984 | Sano | |
| 5,035,969 | A | 7/1991 | Kondo | |
| 6,080,518 | A * | 6/2000 | Levin et al. | 430/58.4 |
| 8,557,488 | B2 | 10/2013 | Nagasaka et al. | |
| 2006/0019185 | A1 | 1/2006 | Amamiya et al. | |
| 2006/0110668 | A1 * | 5/2006 | Kawasaki et al. | 430/58.7 |
| 2011/0159419 | A1 | 6/2011 | Iwamoto | |
| 2011/0207041 | A1 | 8/2011 | Miyamoto | |
| 2012/0301178 | A1 * | 11/2012 | Nonaka et al. | 399/111 |
| 2013/0137020 | A1 * | 5/2013 | Nagasaka et al. | 430/56 |
| 2013/0137024 | A1 * | 5/2013 | Nonaka et al. | 430/56 |

FOREIGN PATENT DOCUMENTS

| | | | |
|---|---|---|---|
| CN | 1043575 | A | 7/1990 |
| CN | 001358282 | A | 7/2002 |
| CN | 1410836 | A | 4/2003 |

(Continued)

OTHER PUBLICATIONS

Sharp Technical Journal No. 101, Aug. 2010, Fukushaki gazo furyo no teiryotekina hyoka hoho no kakuritsu (Establishment of quantitative evaluation method of image defects in copying machine).

(Continued)

*Primary Examiner* — Hoa V Le
(74) *Attorney, Agent, or Firm* — Canon U.S.A., Inc., IP Division

(57) ABSTRACT

An electrophotographic photosensitive member has a surface layer that contains a polymer produced by the polymerization of a charge transporting substance having two or more methacryloyloxy groups per molecule. The surface layer contains a quinone derivative at a concentration of 5 ppm or more and 1500 ppm or less of the total mass of the polymer. The quinone derivative is a compound represented by the following formula (1) or a compound represented by the following formula (2) or both.

15 Claims, 2 Drawing Sheets

(56) References Cited

FOREIGN PATENT DOCUMENTS

| | | | |
|---|---|---|---|
| CN | 1722004 | A | 1/2006 |
| CN | 001811605 | A | 8/2006 |
| EP | 1198735 | B1 | 2/2007 |
| EP | 2219080 | A2 | 8/2010 |
| EP | 2328032 | A2 | 6/2011 |
| JP | 63-097959 | A | 4/1988 |
| JP | 2-230254 | A | 9/1990 |
| JP | H0363657 | A | 3/1991 |
| JP | 08-123055 | A | 5/1996 |
| JP | 2000-066425 | A | 3/2000 |
| JP | 2000-206715 | A | 7/2000 |
| JP | 2000-206716 | A | 7/2000 |
| JP | 2005-062302 | A | 3/2005 |
| JP | 2005115353 | A | 4/2005 |
| JP | 2006010816 | A | 1/2006 |
| JP | 2006047949 | A | 2/2006 |
| JP | 2007-279678 | A | 10/2007 |
| JP | 2009015306 | A | 1/2009 |
| JP | 2010-085832 | A | 4/2010 |
| JP | 2010085832 | A | 4/2010 |
| JP | 2010156835 | A | 7/2010 |
| JP | 2011137953 | A | 7/2011 |
| JP | 2011175188 | A | 9/2011 |
| WO | WO2005114331 | A1 | 12/2005 |

OTHER PUBLICATIONS

Frederick D. Lewis, Todd L. Kurth and Weizhong Liu, "Luminescence of extended and folded N,N'-diarylureas", Photochem,Photobiol,Sci.,2002,1,p. 30-37.

Robert A. Batey, V. Santhakumar, Chiaki Yoshina-Ishii, Scott D. Taylor, "An Efficient New Protocol for the Formation of Unsymmetrical Tri- and Tetrasubstituted Ureas" ,Tetrahedron Letter 39(1998) p. 6267-6270.

Kin-ya Akiba, Satoru Matsunami, Chikahiko Eguchi, and Naoki Inamoto, "Chemistry of Nitrosoimines. VI. Attempted Syntheses of Some Resonance Stabilized Nitrosoimines and Their UV Spectra", Bulletin of the Chemical Society of Japan,vol. 47(4),1974, p. 935-937.

Ernst Bergmann and A. Weitzmann, "The Structure of Urea and Its Derivatives" Transaction of the Faraday Society,34,1938,p. 783-786.

U.S. Appl. No. 13/477,492, filed May 22, 2012, Hideaki Nagasaka.

U.S. Appl. No. 13/477,821, filed May 22, 2012, Masaki Nonaka.

U.S. Appl. No. 13/477,410, filed May 22, 2012, Masato Tanaka.

U.S. Appl. No. 13/477,876, filed May 22, 2012, Masaki Nonaka.

Arthur S. Diamond, Handbook of Imaging Materials, pp. 395-396, Michael Dekker, Inc., NY (1991).

* cited by examiner

ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, a method of producing the electrophotographic photosensitive member, a process cartridge, and an electrophotographic apparatus.

2. Description of the Related Art

In recent years, for the purpose of extending the life of an electrophotographic photosensitive member, improving image quality, and increasing the processing speed of an electrophotographic apparatus, it has been desired to improve the durability of an organic electrophotographic photosensitive member containing an organic photoconductive substance (charge generating substance) (hereinafter referred to as an "electrophotographic photosensitive member").

The improvement of the durability of the electrophotographic photosensitive member may be an improvement of mechanical durability, such as resistance to abrasion and scratches, an improvement of electric potential stability during repeated charging and discharging of electricity, or the prevention of image deletion caused by discharge products resulting from charging, such as ozone and nitrogen oxide. There is a demand for an electrophotographic photosensitive member that satisfies both the improvements of mechanical durability and electric potential stability and the prevention of image deletion in order to achieve an electrophotographic photosensitive member having excellent image stability.

Japanese Patent Laid-Open No. 2000-066425 discloses a technique for providing a surface layer with a polymer produced by the polymerization of a charge transporting substance having two or more chain-polymerizable functional groups (acryloyloxy groups and/or methacryloyloxy groups) to improve the mechanical durability (abrasion resistance) and the electric potential stability of an electrophotographic photosensitive member. Japanese Patent Laid-Open No. 2010-156835 discloses a technique for providing a surface layer with a charge transporting substance having two or more methacryloyl groups per molecule and a polymer of a composition containing no polymerization initiator to improve the mechanical durability (abrasion resistance) and the electric potential stability of an electrophotographic photosensitive member.

The present inventors found that, among the chain-polymerizable charge transporting substances described in Japanese Patent Laid-Open No. 2000-066425, a charge transporting substance having a methacryloyloxy group can more improve mechanical durability and allows an electrophotographic photosensitive member to be used more times than a charge transporting substance having an acryloyloxy group. However, the present inventors also found that a charge transporting substance having a methacryloyloxy group has more room for improvement in terms of image deletion, memory, and spot leakage (leakage that causes spots in output images) resulting from an increase in the number of times an electrophotographic photosensitive member is used. A charge transporting substance having two or more methacryloyl groups used in Japanese Patent Laid-Open No. 2010-156835 tends to cause distortion of the layer and consequently memory and spot leakage. It was also found that the prevention of image deletion must be improved.

SUMMARY OF THE INVENTION

The present invention provides an electrophotographic photosensitive member having a surface layer that contains a polymer produced by the polymerization of a compound having a chain-polymerizable functional group. The electrophotographic photosensitive member can significantly reduce memory, spot leakage, and image deletion in repeated use. The present invention also provides a method of producing the electrophotographic photosensitive member. The present invention also provides a process cartridge and an electrophotographic apparatus each including the electrophotographic photosensitive member.

These can be achieved by the present invention.

The present invention relates to an electrophotographic photosensitive member that includes a support and a photosensitive layer provided on the support. The electrophotographic photosensitive member has a surface layer that contains a polymer produced by the polymerization of a charge transporting substance having two or more methacryloyloxy groups per molecule.

The surface layer contains a quinone derivative at a concentration of 5 ppm or more and 1500 ppm or less of the total mass of the polymer. The quinone derivative is a compound represented by the following formula (1) or a compound represented by the following formula (2) or both.

(1)

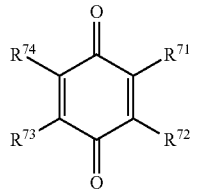

(2)

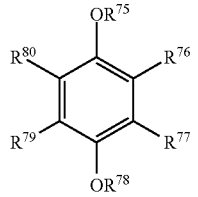

In the formulas (1) and (2), $R^{71}$ to $R^{74}$, $R^{76}$, $R^{77}$, $R^{79}$, and $R^{80}$ each independently represents a hydrogen atom, a hydroxy group, a substituted or unsubstituted alkyl group, a substituted or unsubstituted aryl group, or a substituted or unsubstituted alkoxy group. At least one of $R^{71}$ and $R^{74}$, at least one of $R^{72}$ and $R^{73}$, at least one of $R^{76}$ and $R^{80}$, and at least one of $R^{77}$ and $R^{79}$ each independently represents a hydrogen atom, a methyl group, or a hydroxy group. $R^{75}$ and $R^{78}$ each independently represents a hydrogen atom, a substituted or unsubstituted alkyl group, or a substituted or unsubstituted aryl group, and at least one of $R^{75}$ and $R^{78}$ is a hydrogen atom. A substituent group of the substituted alkyl group, a substituent group of the substituted aryl group, and a substituent group of the substituted alkoxy group may be a carboxy group, a cyano group, a dialkylamino group, a hydroxy group, an alkyl group, an alkoxy-substituted alkyl group, a halogen-substituted alkyl group, an alkoxy group, an alkoxy-substituted alkoxy group, a halogen-substituted alkoxy group, a nitro group, or a halogen atom.

The present invention relates to a method of producing the electrophotographic photosensitive member, wherein the method involves forming a coat by the use of a surface-layer coating solution containing the charge transporting substance and the quinone derivative, and forming a surface layer by the polymerization of the charge transporting substance contained in the coat.

The present invention also relates to a process cartridge detachably attachable to the main body of an electrophotographic apparatus. The process cartridge integrally supports the electrophotographic photosensitive member and at least one device selected from the group consisting of a charging device, a developing device, a transferring device, and a cleaning device.

The present invention also relates to an electrophotographic apparatus that includes the electrophotographic photosensitive member, a charging device, an exposure device, a developing device, and a transferring device.

The present invention can provide an electrophotographic photosensitive member having a surface layer that contains a polymer produced by the polymerization of a compound having a chain-polymerizable functional group. The electrophotographic photosensitive member can significantly reduce memory, spot leakage, and image deletion in repeated use in which images are formed on approximately 10 to 200,000 pieces of paper. The present invention can also provide a method of producing the electrophotographic photosensitive member. The present invention can also provide a process cartridge and an electrophotographic apparatus each including the electrophotographic photosensitive member.

Further features of the present invention will become apparent from the following description of exemplary embodiments with reference to the attached drawings.

DESCRIPTION OF THE EMBODIMENTS

Figure 1A:
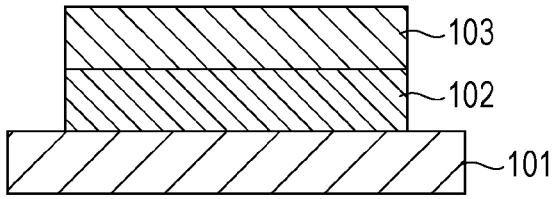
FIGS. 1A and 1B are schematic views of the layer structure of an electrophotographic photosensitive member according to an embodiment of the present invention.

As described above, the present invention provides an electrophotographic photosensitive member that includes a support and a photosensitive layer provided on the support. The electrophotographic photosensitive member has a surface layer that contains a polymer produced by the polymerization of a charge transporting substance having two or more methacryloyloxy groups per molecule. The surface layer contains a quinone derivative at a concentration of 5 ppm or more and 1500 ppm or less of the total mass of the polymer. The quinone derivative is a compound represented by the following formula (1) or a compound represented by the following formula (2) or both.

The charge transporting substance having two or more methacryloyloxy groups per molecule is a compound having a chain-polymerizable functional group.

An electrophotographic photosensitive member according to an embodiment of the present invention can significantly reduce memory, spot leakage, and image deletion in repeated use. The present inventors believe the reason for this as follows.

In the presence of many radicals during a polymerization reaction, the methacryloyloxy groups of the charge transporting substance can rapidly react with each other to form a polymer having high mechanical durability. However, rapid polymerization of the methacryloyloxy groups tends to cause distortion of a charge transporting structure of the charge transporting substance. The distortion of a charge transporting structure may result in different oxidation potentials of the charge transporting structure or different charge mobilities in the fine structure of the charge transporting substance, thus causing memory. The distortion of a charge transporting structure tends to cause distortion of the layer and consequently spot leakage.

A compound represented by the formula (1) and a compound represented by the formula (2) (a quinone derivative) according to an embodiment of the present invention can easily deactivate radicals. When the amount of compound represented by the formula (1) and compound represented by the formula (2) is 5 ppm or more and 1500 ppm or less of the total mass of the polymer, these compounds can deactivate many radicals produced in a polymerization reaction, thereby reducing the polymerization rate. The decrease in polymerization rate can reduce the distortion of a charge transporting structure, memory, and spot leakage.

An electrophotographic photosensitive member according to an embodiment of the present invention can reduce image deletion. Image deletion is a phenomenon in which a blurred electrostatic latent image results in a blurred output image. It is believed that the reason for image deletion is that wet discharge products remaining on the surface of an electrophotographic photosensitive member decrease the surface resistance of the electrophotographic photosensitive member and that nitrogen oxide impairs the charge transporting function of a charge transporting substance.

Although a surface layer that contains a polymer produced by the polymerization of a charge transporting substance having two or more methacryloyloxy groups per molecule has excellent mechanical durability, it is difficult to refresh the surface layer, and image deletion tends to occur.

The present inventors believe that the surface layer is struck by charged particles during charging, and the polymer on the surface layer is cleaved into radicals. This generates polar groups from the cleaved portion and makes it difficult to refresh the surface layer.

The particular amount of compound represented by the formula (1) and compound represented by the formula (2) in the surface layer can reduce the radical cleavage of the polymer and thereby image deletion.

A surface layer of an electrophotographic photosensitive member according to an embodiment of the present invention contains a quinone derivative composed of a compound represented by the following formula (1) or a compound represented by the following formula (2) or both.

(1)

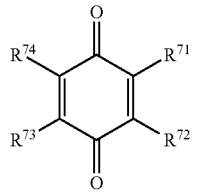

(2)

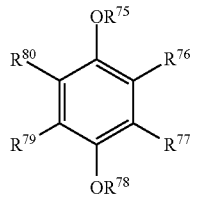

In the formulas (1) and (2), $R^{71}$ to $R^{74}$, $R^{76}$, $R^{77}$, $R^{79}$, and $R^{80}$ each independently represents a hydrogen atom, a hydroxy group, a substituted or unsubstituted alkyl group, a substituted or unsubstituted aryl group, or a substituted or unsubstituted alkoxy group. At least one of $R^{71}$ and $R^{74}$, at least one of $R^{72}$ and $R^{73}$, at least one of $R^{76}$ and $R^{80}$, and at least one of $R^{77}$ and $R^{79}$ each independently represents a hydrogen atom, a methyl group, or a hydroxy group. $R^{75}$ and $R^{78}$ each independently represents a hydrogen atom, a substituted or unsubstituted alkyl group, or a substituted or unsubstituted aryl group, and at least one of $R^{75}$ and $R^{78}$ is a hydrogen atom. A substituent group of the substituted alkyl group, a substituent group of the substituted aryl group, and a substituent group of the substituted alkoxy group may be a carboxy group, a cyano group, a dialkylamino group, a hydroxy group, an alkyl group, an alkoxy-substituted alkyl group, a halogen-substituted alkyl group, an alkoxy group, an alkoxy-substituted alkoxy group, a halogen-substituted alkoxy group, a nitro group, or a halogen atom.

Examples of the alkyl group include, but are not limited to, a methyl group, an ethyl group, and a n-propyl group. Examples of an alkoxy-substituted alkyl group in these compounds include, but are not limited to, a methoxymethyl group and an ethoxymethyl group. Examples of the halogen-substituted alkyl group include, but are not limited to, a trifluoromethyl group and a trichloromethyl group. Examples of the alkoxy group include, but are not limited to, a methoxy group and an ethoxy group. Examples of the alkoxy-substituted alkoxy group include, but are not limited to, a methoxymethoxy group and an ethoxymethoxy group. Examples of the halogen-substituted alkoxy group include, but are not limited to, a trifluoromethoxy group and a trichloromethoxy group. Examples of the halogen atom include, but are not limited to, a fluorine atom, a chlorine atom, and a bromine atom. Examples of the dialkylamino group include, but are not limited to, a dimethylamino group and a diethylamino group.

In the formula (2), $R^{75}$ may be a hydrogen atom, and $R^{78}$ may be a substituted or unsubstituted alkyl group or a substituted or unsubstituted aryl group. $R^{78}$ may be a methyl group. A compound represented by the following formula (2) may be p-methoxyphenol (an exemplary compound (2-1) described below).

The following are exemplary compounds of a compound represented by the formula (1) and a compound represented by the formula (2).

(1-1)

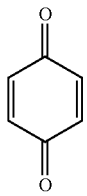

(1-2)

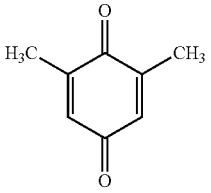

(1-3)

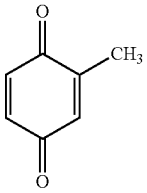

-continued (1-4)

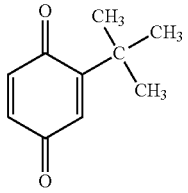

(2-1)

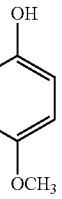

(2-2)

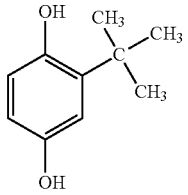

(2-3)

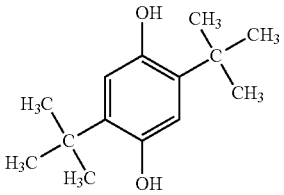

(2-4)

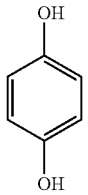

(2-5)

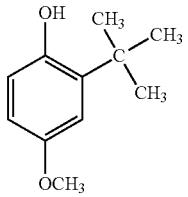

(2-6)

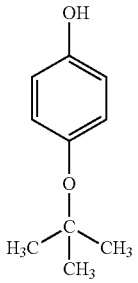

-continued (2-7)

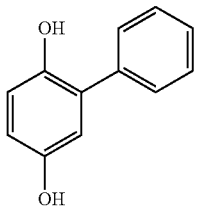

(2-8)

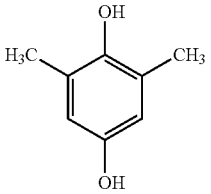

(2-9)

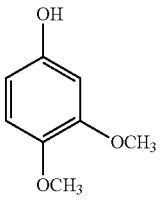

(2-10)

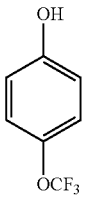

(2-11)

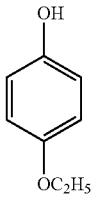

(2-12)

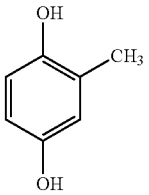

(2-13)

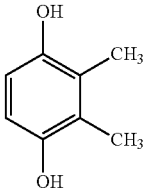

-continued (2-14)

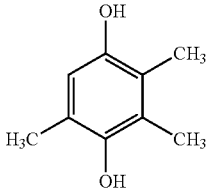

(2-15)

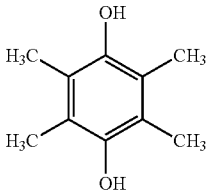

In order to control the chain polymerization reaction rate and reduce memory, spot leakage, and image deletion, the amount of compound represented by the formula (1) and compound represented by the formula (2) is 5 ppm or more and 1500 ppm or less of the total mass of the polymer. When the amount is 5 ppm or less, this results in insufficient effects of deactivating radicals and preventing image deletion. When the amount is more than 1500 ppm, this results in excessive deactivation of radicals and inhibition of the polymerization reaction. This results in the formation of unreacted methacryloyloxy groups and tends to cause memory or spot leakage. Furthermore, this results in an increase in the number of unreacted methacryloyloxy groups, which can easily undergo radical cleavage by charging, and a small image deletion preventing effect. The amount of compound represented by the formula (1) and compound represented by the formula (2) is preferably 5 ppm or more and 100 ppm or less to prevent memory and spot leakage and more preferably 10 ppm or more and 90 ppm or less.

Japanese Patent Laid-Open No. 2010-85832 discloses an electrophotographic photosensitive member that contains 2000 ppm or more p-methoxyphenol in a surface layer. Japanese Patent Laid-Open No. 2011-175188 discloses an electrophotographic photosensitive member that contains 12000 ppm of a radical deactivator in a surface layer. As described above, these surface layers have an excessive radical deactivation effect, which inhibits the polymerization reaction and reduces mechanical durability. Thus, memory and spot leakage tends to occur.

A charge transporting substance having two or more methacryloyloxy groups per molecule is used in an embodiment of the present invention. A charge transporting substance may be any substance that can transport charges and may be a triarylamine compound, a hydrazone compound, a stilbene compound, a pyrazoline compound, an oxazole compound, a thiazole compound, or a triallylmethane compound.

The charge transporting substance may be at least one of a compound represented by the following formula (3) and a compound represented by the following formula (4).

(3)

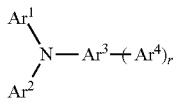

-continued (4)

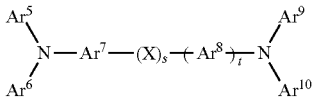

In the formulas (3) and (4), r, s, and t each independently represents 0 or 1. $Ar^1$ and $Ar^2$, $Ar^3$ in the case that r is 0 (when r is 0, $Ar^3$ is a monovalent group without $Ar^4$), $Ar^4$ to $Ar^6$, and $Ar^9$ and $Ar^{10}$ each independently represents a group represented by the following formula (M), a substituted or unsubstituted aryl group, or substituted or unsubstituted alkyl group. $Ar^3$ in the case that r is 1 (when r is 1, $Ar^3$ is a divalent group), $Ar^7$, and $Ar^8$ each independently represents a group represented by the following formula (M') or a substituted or unsubstituted arylene group. At least two of $Ar^1$ to $Ar^4$ and at least two of $Ar^5$ to $Ar^{10}$ are a group represented by the following formula (M) or (M'). X represents an oxygen atom, a cycloalkylidene group, a divalent group having two phenylene groups bonded with an oxygen atom, or an ethylene group. The aryl group is a monovalent group derived from a stilbene group by loss of one hydrogen atom, a phenyl group, a biphenylyl group, a fluorenyl group, a carbazolyl group, or a styryl group. The arylene group is a divalent group derived from a styrene group by loss of two hydrogen atoms, a phenylene group, a biphenylylene group, a fluorenediyl group, or a carbazolediyl group. The substituent group described above or a substituent group of a group represented by the following formula (M) or (M') may be a carboxy group, a cyano group, a dialkylamino group, a hydroxy group, an alkyl group, an alkoxy-substituted alkyl group, a halogen-substituted alkyl group, an alkoxy group, an alkoxy-substituted alkoxy group, a halogen-substituted alkoxy group, a nitro group, or a halogen atom.

In compounds represented by the formula (3) and (4), r may be 0, or s may be 0 and t may be 1.

(M)

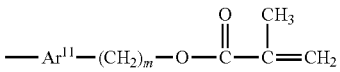

(M')

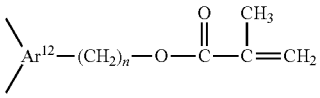

In the formulas (M) and (M'), $Ar^{11}$ represents a substituted or unsubstituted arylene group. $Ar^{12}$ represents a substituted or unsubstituted trivalent aromatic group. The arylene group is a divalent group derived from a stilbene group or a styrene group by loss of two hydrogen atoms, a phenylene group, a biphenylylene group, a fluorenediyl group, or a carbazolediyl group. The trivalent aromatic group is a trivalent group derived from benzene, biphenyl, fluorene, carbazole, or styrene by loss of three hydrogen atoms. m and n each independently represents an integer number selected from 2 to 6.

The monovalent group derived from a stilbene group by loss of one hydrogen atom may be a monovalent group derived from stilbene by loss of one hydrogen atom of its benzene ring. The divalent group derived from a stilbene group by loss of two hydrogen atoms may be a divalent group derived from stilbene by loss of two hydrogen atoms of its benzene ring. The divalent group derived from a styrene group by loss of two hydrogen atoms may be a divalent group derived from a styryl group by loss of one hydrogen atom of its benzene ring. The trivalent group derived from a styrene group by loss of three hydrogen atoms may be a trivalent group derived from a styryl group by loss of two hydrogen atoms of its benzene ring.

When m is 2 or more and 6 or less in the group represented by the formula (M) or (M'), the alkylene group between the charge transporting structure and the methacryloyloxy group has an appropriate length, that is, the charge transporting structure is not distorted during polymerization, and a satisfactory cross-linked structure can be formed.

In order to reduce memory and spot leakage, m or n of the group represented by the formula (M) or (M') in the compound represented by the formula (3) and the compound represented by the formula (4) may be 2 or 3. Preferably, the compound represented by the formula (3) may have at least one of the $Ar^1$ to $Ar^4$ is the group represented by the formula (M) that m is 3, or the group represented by the formula (M') that n is 3, and at least one of the $Ar^1$ to $Ar^4$ is the group represented by the formula (M) that m is 2, or the group represented by the formula (M') that n is 2. Preferably, the compound represented by the formula (4) may have at least one of the $Ar^1$ to $Ar^4$ is the group represented by the formula (M) that m is 2, or the group represented by the formula (M') that n is 2, and at least one of the $Ar^5$ to $Ar^{10}$ is the group represented by the formula (M) that m is 2, or the group represented by the formula (M') that n is 2.

A surface layer may contain one or two or more compounds represented by the formula (3) and/or compounds represented by the formula (4).

A charge transporting substance having two or more methacryloyloxy groups per molecule according to an embodiment of the present invention may be synthesized by a method described in Japanese Patent Laid-Open No. 2010-156835. The following are specific examples of a compound represented by the formula (3) and a compound represented by the formula (4). The present invention is not limited to these examples. M2 to M5 in the exemplary compounds each independently represents a methacryloyloxy group having an alkylene group having 2 to 5 carbon atoms described below.

M2

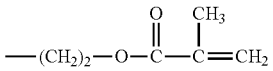

M3

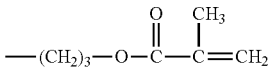

M4

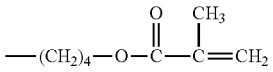

M5

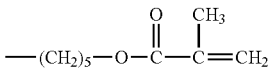

-continued
(3A-1)
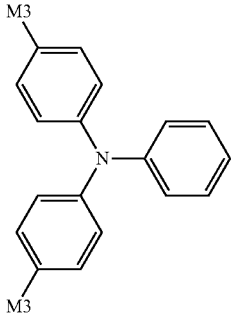
(3A-2)
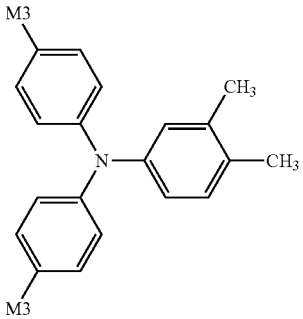
(3A-3)
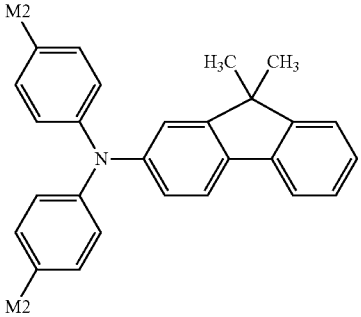
(3A-4)
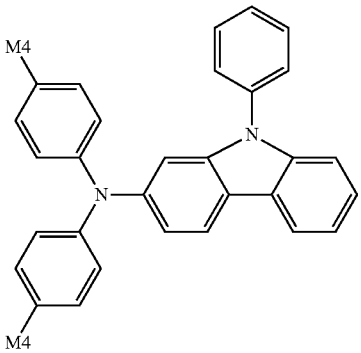
(3A-5)
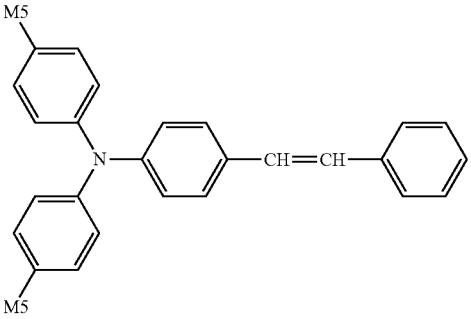
-continued
(3A-6)
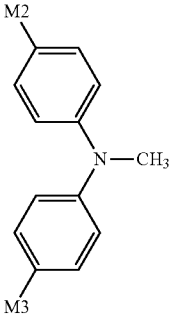
(3A-7)
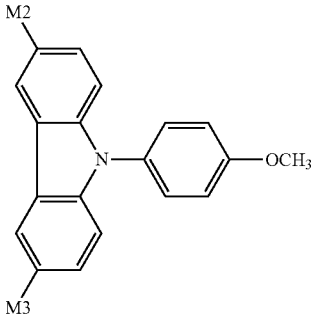
(3A-8)
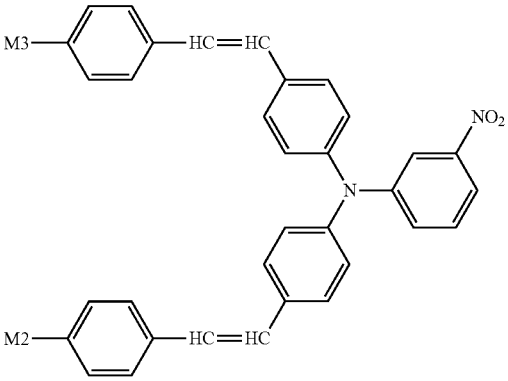
(3A-9)
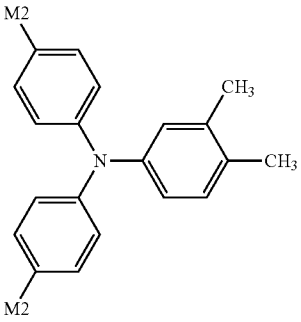

-continued
(3A-10)
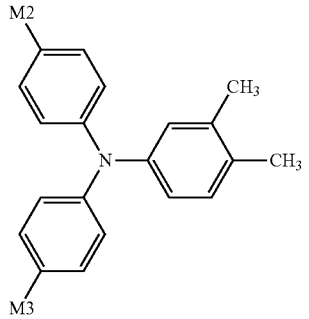
(3A-11)
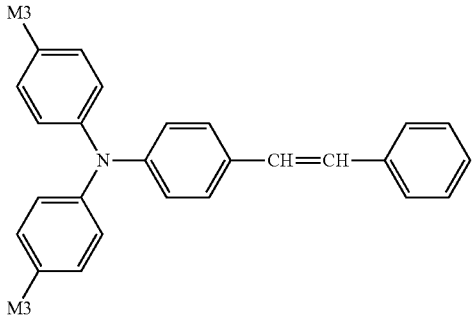
(3A-12)
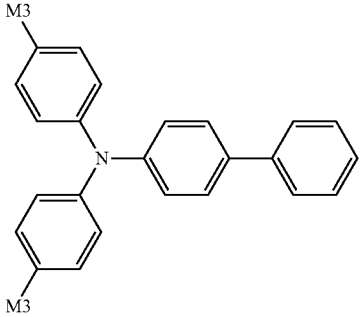
(4A-1)
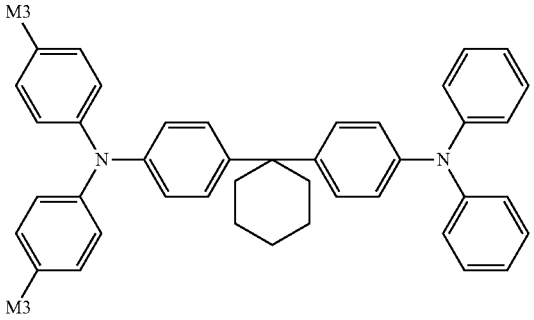
(4A-2)
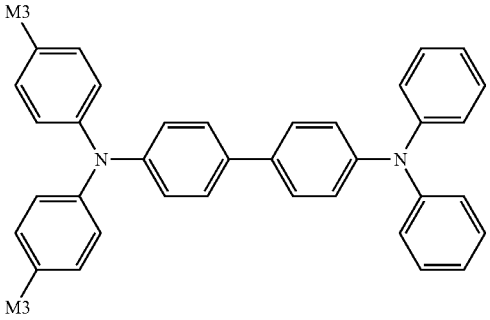
-continued
(4A-3)
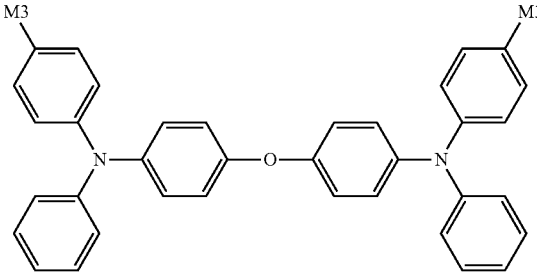
(4A-4)
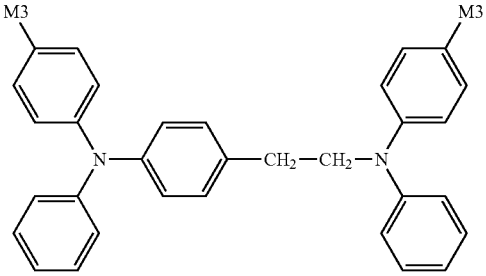
(4A-5)
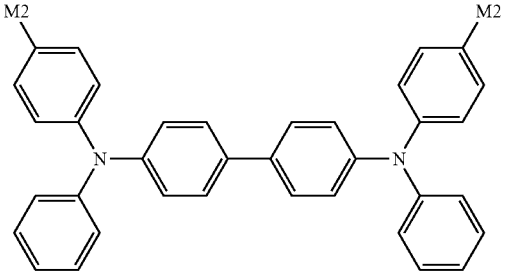
(4A-6)
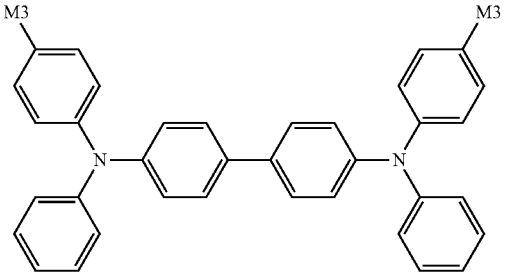
(4A-7)
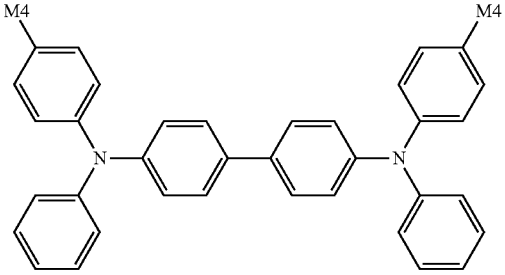

-continued
(4A-8)
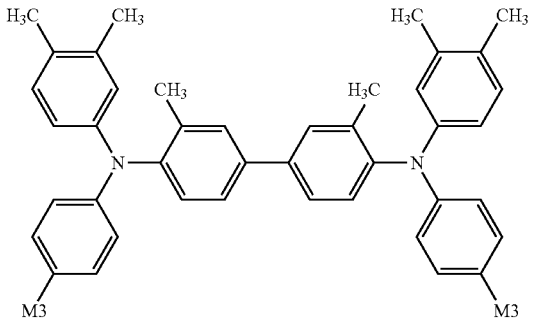
(4A-9)
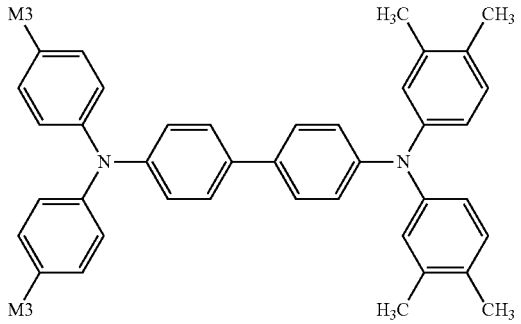
(4A-10)
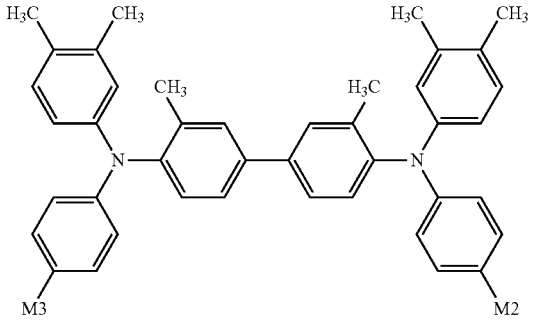
(3B-1)
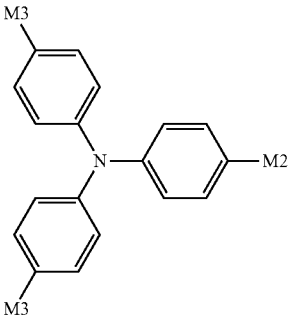
-continued
(3B-2)
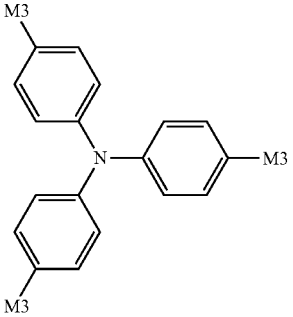
(3B-3)
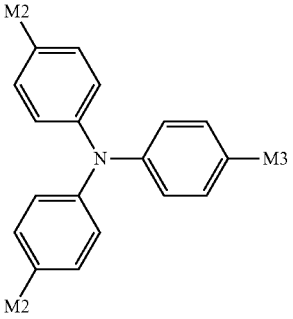
(3B-4)
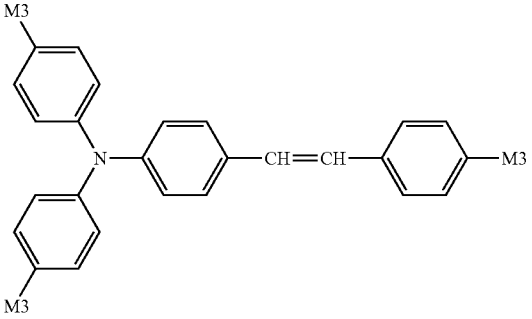
(3B-5)
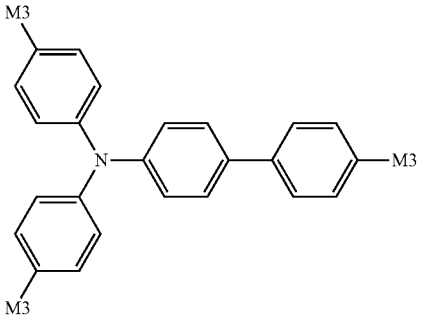
(4B-1)
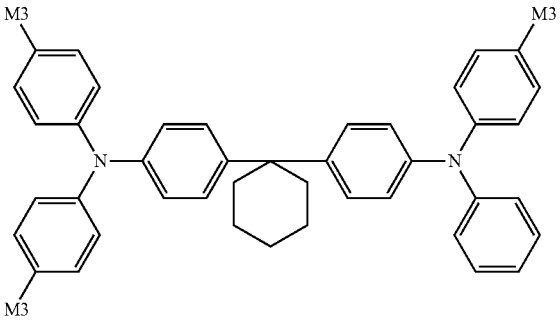

-continued
(4B-2)
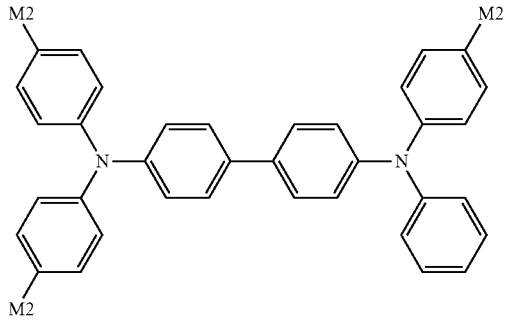
(4B-3)
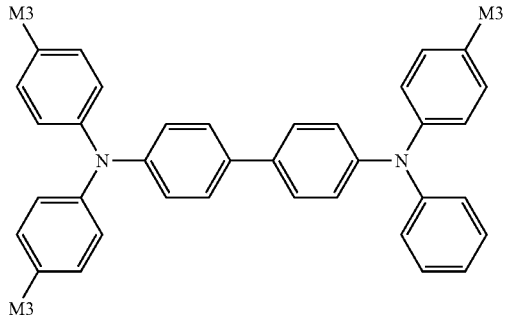
(4B-4)
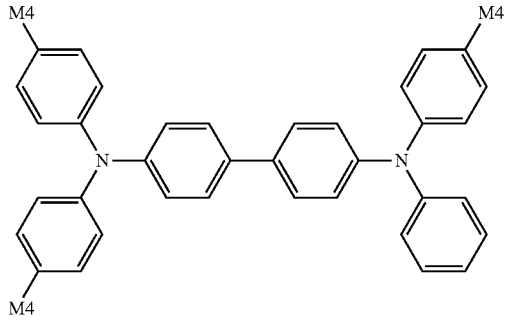
(4B-5)
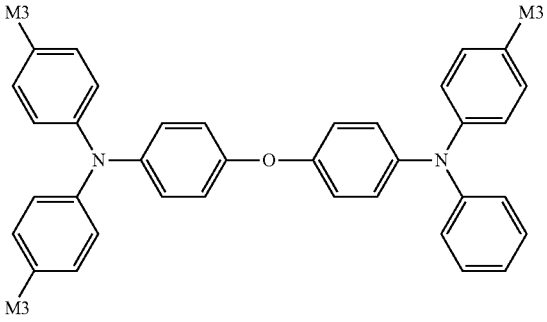
-continued
(4C-1)
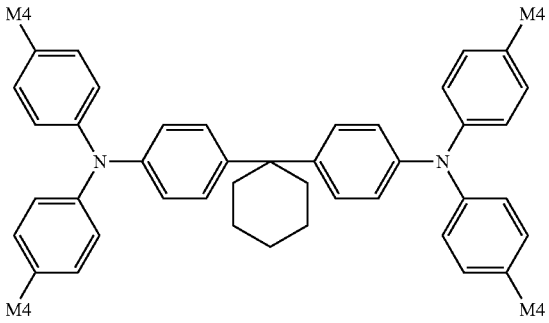
(4C-2)
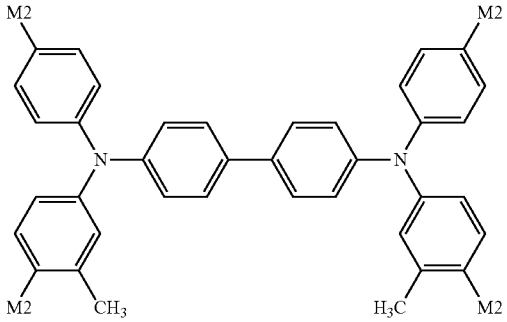
(4C-3)
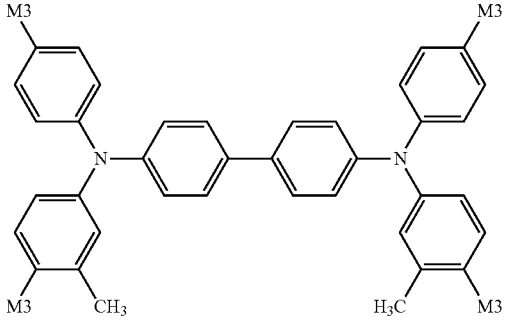
(4C-4)
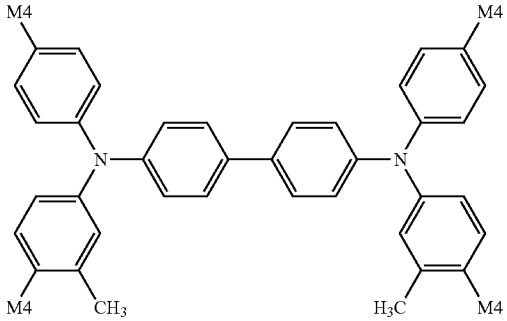

-continued
(4C-5)
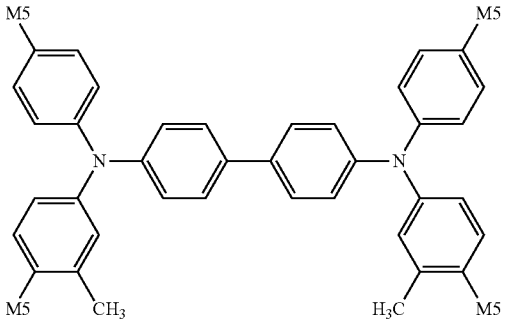
(4C-6)
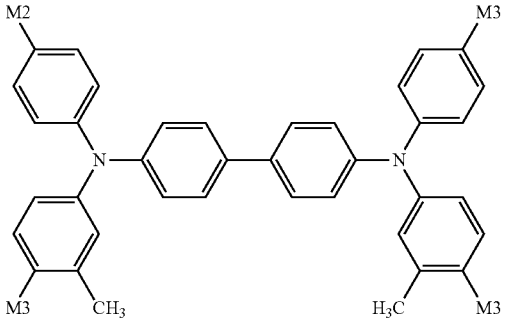
(4C-7)
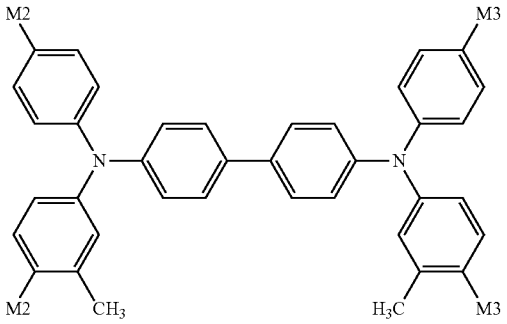
(4C-8)
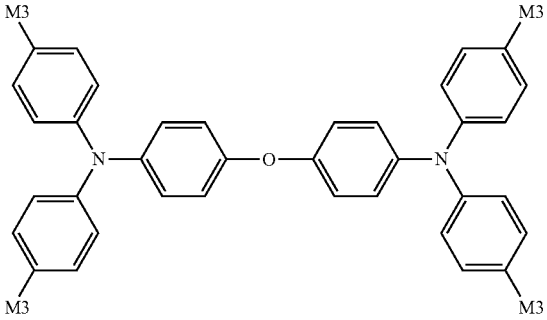
-continued
(4C-9)
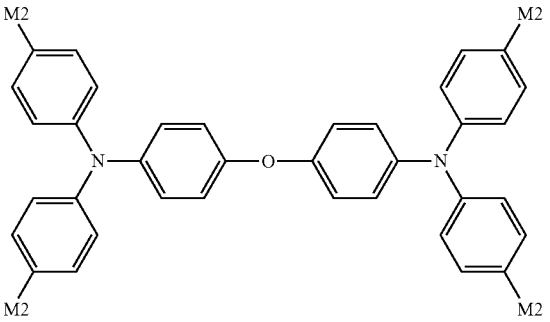
(4C-10)
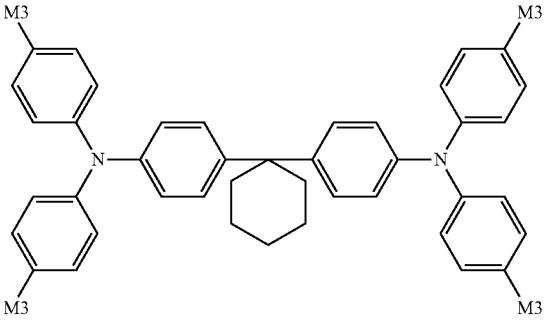
(3C-1)
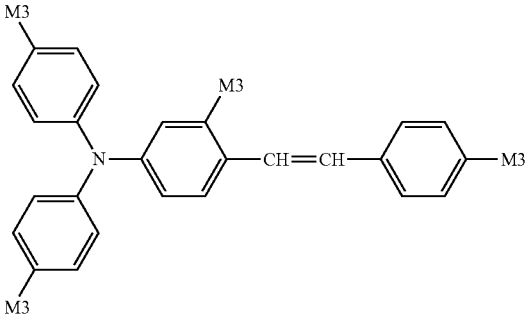
(3C-2)
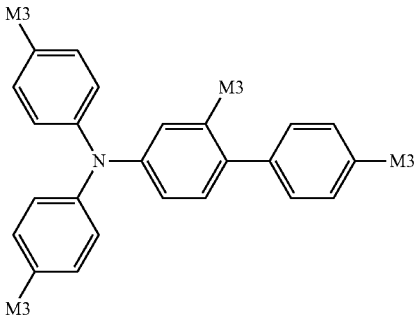

-continued (3C-3)

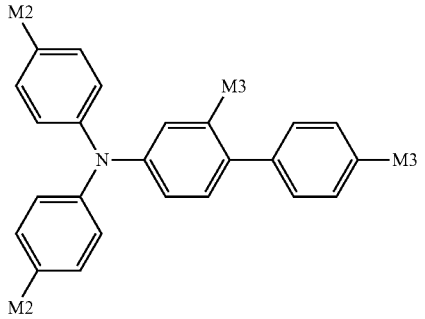

(4D-1)

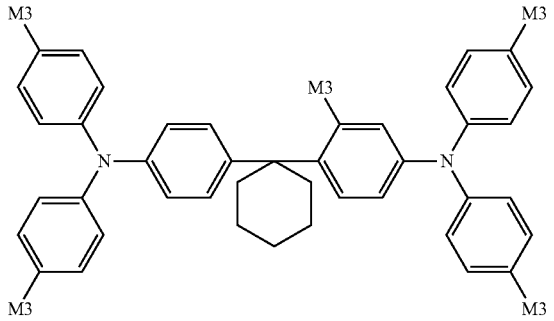

(4E-1)

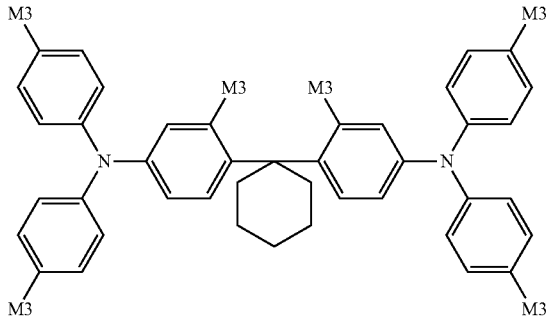

The photosensitive layer may be a monolayer photosensitive layer that contains a charge generating substance and a charge transporting substance or a multilayer (function-separated) photosensitive layer that includes a charge generating layer containing a charge generating substance and a charge transporting layer containing a charge transporting substance. An electrophotographic photosensitive member according to an embodiment of the present invention can have a multilayer photosensitive layer. The charge transporting layer may also have a multilayer structure. The charge transporting layer may be covered with a protective layer.

Figure 1B:
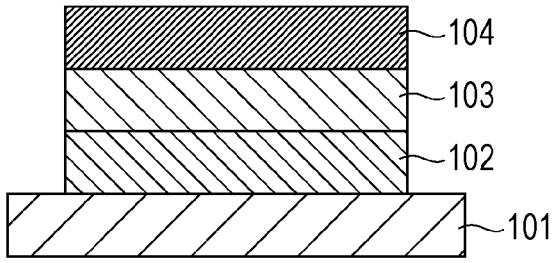

FIGS. 1A and 1B are schematic views of the layer structure of an electrophotographic photosensitive member according to an embodiment of the present invention. The layer structures include a support 101, a charge generating layer 102, a charge transporting layer 103, and a protective layer (second charge transporting layer) 104. If necessary, an undercoat layer may be disposed between the support 101 and the charge generating layer 102. The term "a surface layer of an electrophotographic photosensitive member", as used herein, refers to the outermost layer. In an electrophotographic photosensitive member having the layer structure illustrated in FIG. 1A, the surface layer of the electrophotographic photosensitive member is the charge transporting layer 103. In an electrophotographic photosensitive member having the layer structure illustrated in FIG. 1B, the surface layer of the electrophotographic photosensitive member is the protective layer 104.

An electrophotographic photosensitive member according to an embodiment of the present invention can be produced by a method that involves forming a coat by the use of a surface-layer coating solution that contains a compound represented by the formula (1), a compound represented by the formula (2), and a charge transporting substance having two or more methacryloyloxy groups per molecule, and forming a surface layer by the polymerization (chain polymerization) of the charge transporting substance contained in the coat.

The polymer contained in a surface layer of an electrophotographic photosensitive member according to an embodiment of the present invention may be a polymer produced by the polymerization (chain polymerization) of a composition that contains a charge transporting substance having two or more methacryloyloxy groups per molecule and another compound having a methacryloyloxy group. Use of a compound represented by the following formula (A) (an adamantane compound) as another compound having a methacryloyloxy group can prevent microaggregation of a portion having a charge transporting function of the charge transporting substance and make a polymerization reaction uniform. A compound represented by the following formula (B) or a compound represented by the following formula (C) (a urea compound) has an image deletion preventing effect without inhibiting the polymerization reaction. A compound represented by the following formula (A), (B), or (C) may have two or more methacryloyloxy groups to increase the cross-linking density.

(A)

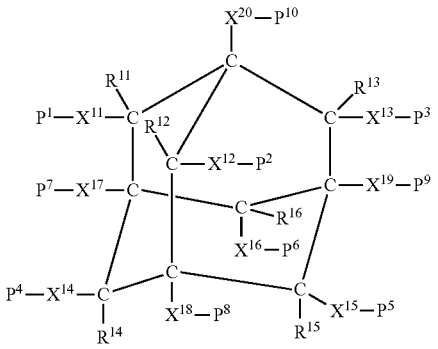

In the formula (A), $R^{11}$ to $R^{16}$ each independently represents a hydrogen atom, a methyl group, an ethyl group, a n-propyl group, a trifluoromethyl group, a hydroxy group, a methoxy group, an ethoxy group, an amino group, a dimethylamino group, a trimethylsilyl group, a fluorine atom, a chlorine atom, or a bromine atom. $X^{11}$ to $X^{20}$ each independently represents a single bond or an alkylene group. $P^1$ to $P^{10}$ each independently represents a hydrogen atom, a methyl group, an ethyl group, a n-propyl group, a trifluoromethyl group, a hydroxy group, a methoxy group, an ethoxy group, an amino group, a dimethylamino group, a trimethylsilyl group, a fluorine atom, a chlorine atom, a bromine atom, or a methacryloyloxy group. When $X^{11}$ is a single bond, $P^1$ and $R^{11}$ may combine to form an oxo group (=O). When $X^{12}$ is a single bond, $P^2$ and $R^{12}$ may combine to form an oxo group (=O). When $X^{13}$ is a single bond, $P^3$ and $R^{13}$ may combine to form an oxo group (=O). When $X^{14}$ is a single bond, $P^4$ and $R^{14}$ may combine to form an oxo group (=O). When $X^{15}$ is a single bond, $P^5$ and $R^{15}$ may combine to form an oxo group (=O). When $X^{16}$ is a single bond, $P^6$ and $R^{16}$ may combine to form an oxo group (=O). At least one of $P^1$ to $P^{10}$ is a methacryloyloxy group. When $P^1$ is a methacryloyloxy group, $R^{11}$ is a hydrogen atom. When $P^2$ is a methacryloyloxy group, $R^{12}$ is a hydrogen atom. When $P^3$ is a methacryloyloxy group, $R^{13}$ is a hydrogen atom. When $P^4$ is a methacryloyloxy group, $R^{14}$ is a hydrogen atom. When $P^5$ is a methacryloyloxy group, $R^{15}$ is a hydrogen atom. When $P^6$ is a methacryloyloxy group, $R^{16}$ is a hydrogen atom.

(B)

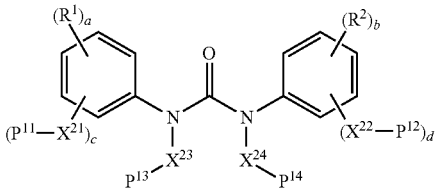

(C)

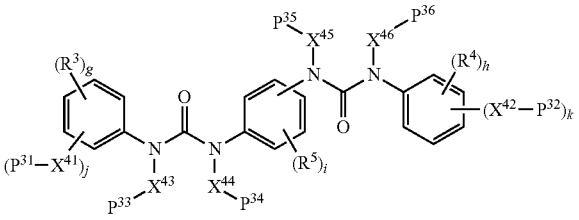

In the formulas (B) and (C), $R^1$ to $R^5$ each independently represents a methyl group, an ethyl group, a n-propyl group, a methoxymethyl group, a trifluoromethyl group, a trichloromethyl group, a methoxy group, an ethoxy group, a propoxy group, a methoxymethoxy group, a trifluoromethoxy group, a trichloromethoxy group, a dimethylamino group, or a fluorine atom. $X^{21}$ to $X^{24}$ and $X^{41}$ to $X^{46}$ each independently represents an alkylene group. $P^{11}$ to $P^{14}$ and $P^{31}$ to $P^{36}$ each independently represents a hydrogen atom or a methacryloyloxy group, and at least one of $P^{11}$ to $P^{14}$ and at least one of $P^{31}$ to $P^{36}$ are methacryloyloxy groups. a, b, g, and h each independently represents an integer number selected from 0 to 5, and i represents an integer number selected from 0 to 4. c, d, j, and k each independently represents 0 or 1.

A surface layer of an electrophotographic photosensitive member according to an embodiment of the present invention may contain various additive agents. Examples of the additive agents include, but are not limited to, antidegradants, such as antioxidants and ultraviolet absorbers, lubricants, such as polytetrafluoroethylene (PTFE) resin fine particles and fluorocarbons, and polymerization control agents, such as polymerization initiators and polymerization terminators. A compound represented by the following formula (D), (E), or (F) in the surface layer has an image deletion preventing effect without inhibiting the polymerization reaction.

(D)

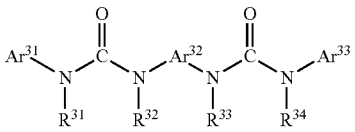

-continued (E)

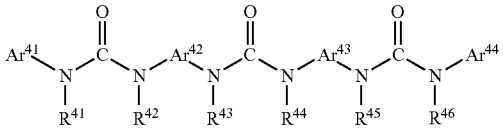

(F)

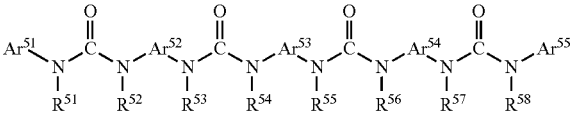

In the formulas (D), (E) and (F), $R^{31}$ to $R^{34}$, $R^{41}$ to $R^{46}$, and $R^{51}$ to $R^{58}$ each independently represents an alkyl group. $Ar^{32}$, $Ar^{42}$ and $Ar^{43}$, and $Ar^{52}$ to $Ar^{54}$ each independently represents a substituted or unsubstituted arylene group. A substituent group of the substituted arylene group may be an alkyl group, an alkoxy-substituted alkyl group, a halogen-substituted alkyl group, an alkoxy group, an alkoxy-substituted alkoxy group, a halogen-substituted alkoxy group, or a halogen atom. $Ar^{31}$, $Ar^{33}$, $Ar^{41}$, $Ar^{44}$, $Ar^{51}$, and $Ar^{55}$ each independently represents a substituted or unsubstituted aryl group or a fused ring. A substituent group of the substituted aryl group may be a carboxy group, a cyano group, a dialkylamino group, a hydroxy group, an alkyl group, an alkoxy-substituted alkyl group, a halogen-substituted alkyl group, an alkoxy group, an alkoxy-substituted alkoxy group, a halogen-substituted alkoxy group, a nitro group, or a halogen atom.

Examples of an alkyl group in the compounds represented by the formulas (3) and (4) and the compounds represented by the formulas (A) to (F) include, but are not limited to, a methyl group, an ethyl group, and a n-propyl group. Examples of an alkylene group in these compounds include, but are not limited to, a methylene group, an ethylene group, and a n-propylene group. Examples of an alkoxy-substituted alkyl group in these compounds include, but are not limited to, a methoxymethyl group and an ethoxymethyl group. Examples of the halogen-substituted alkyl group include, but are not limited to, a trifluoromethyl group and a trichloromethyl group. Examples of the alkoxy group include, but are not limited to, a methoxy group and an ethoxy group. Examples of the alkoxy-substituted alkoxy group include, but are not limited to, a methoxymethoxy group and an ethoxymethoxy group. Examples of the halogen-substituted alkoxy group include, but are not limited to, a trifluoromethoxy group and a trichloromethoxy group. Examples of the halogen atom include, but are not limited to, a fluorine atom, a chlorine atom, and a bromine atom. Examples of the dialkylamino group include, but are not limited to, a dimethylamino group and a diethylamino group.

Examples of the solvent of the surface-layer coating solution include, but are not limited to, alcohol solvents, such as methanol, ethanol, and propanol, ketone solvents, such as acetone, methyl ethyl ketone, and cyclohexanone, ester solvents, such as ethyl acetate and butyl acetate, ether solvents, such as tetrahydrofuran and dioxane, halogen solvents, such as 1,1,2,2,3,3,4-heptafluorocyclopentane, dichloromethane, dichloroethane, and chlorobenzene, aromatic solvents, such as benzene, toluene, and xylene, and cellosolve solvents, such as methyl cellosolve and ethyl cellosolve. These solvents may be used alone or in combination.

The structure of an electrophotographic photosensitive member according to an embodiment of the present invention will be described below.

Support

A support for use in an electrophotographic photosensitive member according to an embodiment of the present invention may be a support having high electrical conductivity (electroconductive support), for example, made of aluminum, an aluminum alloy, or stainless steel. An aluminum or aluminum alloy support may be an ED tube, an EI tube, or a support manufactured by cutting, electrochemical mechanical polishing, or wet or dry honing of these tubes. A metal support or a resin support may be covered with a thin film, for example, made of aluminum, an aluminum alloy, or an electroconductive material, such as an indium oxide-tin oxide alloy. The surface of the support may be subjected to cutting, surface roughening, or alumite treatment.

The support may contain electroconductive particles, such as carbon black, tin oxide particles, titanium oxide particles, or silver particles, dispersed in a resin. The support may also be a plastic containing an electroconductive binder resin.

In an electrophotographic photosensitive member according to an embodiment of the present invention, an electroconductive layer containing electroconductive particles and a resin may be formed on the support. In a method for forming an electroconductive layer containing electroconductive particles and a resin on the support, the electroconductive layer contains a powder containing electroconductive particles. Examples of the electroconductive particles include, but are not limited to, carbon black, acetylene black, powders of aluminum, nickel, iron, nichrome, copper, zinc, silver, and other metals, and powders of metal oxides, such as electroconductive tin oxide and indium-tin oxide (ITO).

Examples of the resin for use in the electroconductive layer include, but are not limited to, acrylic resin, alkyd resin, epoxy resin, phenolic resin, butyral resin, polyacetal resin, polyurethane, polyester, polycarbonate, and melamine resin.

Examples of the solvent for use in the electroconductive-layer coating solution include, but are not limited to, ether solvents, alcohol solvents, ketone solvents, and aromatic hydrocarbon solvents. The thickness of the electroconductive layer is preferably 0.2 μm or more and 40 μm or less, more preferably 5 μm or more and 40 μm or less.

An electrophotographic photosensitive member according to an embodiment of the present invention may include an undercoat layer between the support or the electroconductive layer and the photosensitive layer. The undercoat layer may be formed by applying an undercoat layer coating solution containing a resin to the support or the electroconductive layer and drying or hardening the coating solution.

Examples of the resin for use in the undercoat layer include, but are not limited to, poly(acrylic acid), methylcellulose, ethylcellulose, polyamide resin, polyimide resin, polyamideimide resin, poly(amic acid) resin, melamine resin, epoxy resin, and polyurethane resin. The undercoat layer may contain the electroconductive particles described above.

Examples of the solvent for use in the undercoat layer coating solution include, but are not limited to, ether solvents, alcohol solvents, ketone solvents, and aromatic hydrocarbon solvents. The thickness of the undercoat layer is preferably 0.05 μm or more and 40 μm or less, more preferably in the range of 0.4 to 20 μm. The undercoat layer may contain semiconductive particles, an electron transporting substance, or an electron accepting substance.

Photosensitive Layer

An electrophotographic photosensitive member according to an embodiment of the present invention includes a photosensitive layer (a charge generating layer and a charge transporting layer) on the support, the electroconductive layer, or the undercoat layer.

Examples of the charge generating substance for use in an electrophotographic photosensitive member according to an embodiment of the present invention include, but are not limited to, pyrylium, thiapyrylium dyes, phthalocyanine compounds, anthanthrone pigments, dibenzpyrenequinone pigments, pyranthrone pigments, azo pigments, indigo pigments, quinacridone pigments, and quinocyanine pigments. The charge generating substance may be gallium phthalocyanine. Hydroxy gallium phthalocyanine crystals having strong peaks at Bragg angles 2θ of 7.4°±0.3° and 28.2°±0.3° in CuKα characteristic X-ray diffraction have high sensitivity.

The charge generating layer may be formed by applying a charge generating layer coating solution and drying the coating solution. The charge generating layer coating solution is prepared by dispersing a charge generating substance together with a binder resin and a solvent. The charge generating layer may also be an evaporated film of a charge generating substance.

Examples of the binder resin for use in a charge generating layer of a multilayer photosensitive layer according to an embodiment of the present invention include, but are not limited to, polycarbonate resin, polyester resin, butyral resin, poly(vinyl acetal) resin, acrylic resin, vinyl acetate resin, and urea resin. The binder resin may be a butyral resin. These may be used alone or in combination as a mixture or a copolymer.

In the charge generating layer, the ratio of the binder resin to the charge generating substance may be 0.3 or more and 4 or less based on mass. The dispersion may be performed with a homogenizer, ultrasonic waves, a ball mill, a sand mill, an attritor, or a rolling mill.

Examples of the solvent for use in the charge generating layer coating solution include, but are not limited to, alcohol solvents, sulfoxide solvents, ketone solvents, ether solvents, ester solvents, and aromatic hydrocarbon solvents. The thickness of the charge generating layer is preferably 0.01 μm or more and 5 μm or less, more preferably 0.1 μm or more and 1 μm or less. The charge generating layer may contain an intensifier, an antioxidant, an ultraviolet absorber, and/or a plasticizer, if necessary.

In an electrophotographic photosensitive member having a multilayer photosensitive layer, a charge transporting layer is formed on a charge generating layer.

In the case that the charge transporting layer is the surface layer as illustrated in FIG. 1A, the charge transporting layer can be formed by forming a coat by the use of a charge transporting layer coating solution that contains the charge transporting substance and the quinone derivative dissolved in a solvent and polymerizing the charge transporting substance contained in the coat. The amount of quinone derivative in the charge transporting layer coating solution is 5 ppm or more and 1500 ppm or less of the total mass of the charge transporting substance in the charge transporting layer coating solution.

In the case that the protective layer is the surface layer as illustrated in FIG. 1B, the charge transporting layer can be formed by forming a coat by the use of a charge transporting layer coating solution that contains a charge transporting substance and a binder resin dissolved in a solvent and drying the coat.

In the case that the protective layer is the surface layer as illustrated in FIG. 1B, examples of the charge transporting substance for use in the charge transporting layer include, but are not limited to, triarylamine compounds, hydrazone compounds, stilbene compounds, pyrazoline compounds, oxazole compounds, thiazole compounds, and triallylmethane compounds.

In the case that the protective layer is the surface layer as illustrated in FIG. 1B, examples of the binder resin for use in the charge transporting layer include, but are not limited to, poly(vinyl butyral) resin, polyarylate resin, polycarbonate resin, polyester resin, phenoxy resin, poly(vinyl acetate) resin, acrylic resin, polyacrylamide resin, polyamide resin, polyvinylpyridine, cellulose resin, urethane resin, epoxy resin, agarose resin, casein, poly(vinyl alcohol) resin, and polyvinylpyrrolidone.

In the case that the protective layer is the surface layer as illustrated in FIG. 1B, the charge transporting substance can constitute 30% by mass or more and 70% by mass or less of the total mass of the charge transporting layer.

In the case that the protective layer is the surface layer as illustrated in FIG. 1B, the solvent for use in the charge transporting layer coating solution include, but are not limited to, ether solvents, alcohol solvents, ketone solvents, and aromatic hydrocarbon solvents. The thickness of the charge transporting layer may be 5 μm or more and 40 μm or less.

In accordance with an embodiment of the present invention, a protective layer may be formed on the charge transporting layer. The protective layer can be formed by forming a coat by the use of a protective layer coating solution that contains the charge transporting substance and the quinone derivative dissolved in a solvent and polymerizing the charge transporting substance contained in the coat. The amount of quinone derivative in the protective layer coating solution is 5 ppm or more and 1500 ppm or less of the total mass of the charge transporting substance in the protective layer coating solution.

In the case that a compound having a methacryloyloxy group other than the charge transporting substance having two or more methacryloyloxy groups per molecule is used in the protective layer, the percentage of the charge transporting substance having two or more methacryloyloxy groups per molecule may be 50% by mass or more and less than 100% by mass of the total mass of the protective layer.

The thickness of the protective layer may be 2 μm or more and 20 μm or less.

These coating solutions may be applied by dip coating (dipping), spray coating, spinner coating, bead coating, blade coating, or beam coating.

A polymerization reaction in the formation of the surface layer will be described below. A compound having a chain-polymerizable functional group (a methacryloyloxy group) may be polymerized utilizing heat, light (such as ultraviolet rays), or radioactive rays (such as an electron ray). In particular, polymerization utilizing radioactive rays, such as an electron ray, does not necessarily use a polymerization initiator.

In order to reduce memory, a surface layer of an electrophotographic photosensitive member according to an embodiment of the present invention may contain no polymerization initiator.

Polymerization utilizing an electron ray can produce a three-dimensional network structure having a very high density and achieve excellent electric potential stability. Because of short and efficient polymerization, polymerization utilizing an electron ray has high productivity. An accelerator of an electron ray may be of a scanning type, an electrocurtain type, a broad beam type, a pulse type, or a laminar type.

The following are the conditions for electron ray irradiation. When the accelerating voltage of an electron ray is 120 kV or less, the electron ray does not cause a significant deterioration of material properties while the polymerization efficiency is maintained. The electron ray absorbed dose to the surface of an electrophotographic photosensitive member is preferably 5 kGy or more and 50 kGy or less, more preferably 1 kGy or more and 10 kGy or less.

In order to prevent oxygen from inhibiting electron ray polymerization of a compound having a chain-polymerizable functional group, such as a charge transporting substance having two or more methacryloyloxy groups per molecule, electron ray irradiation in an inert gas atmosphere can be followed by heating in an inert gas atmosphere. Examples of the inert gas include, but are not limited to, nitrogen, argon, and helium.

Figure 2:
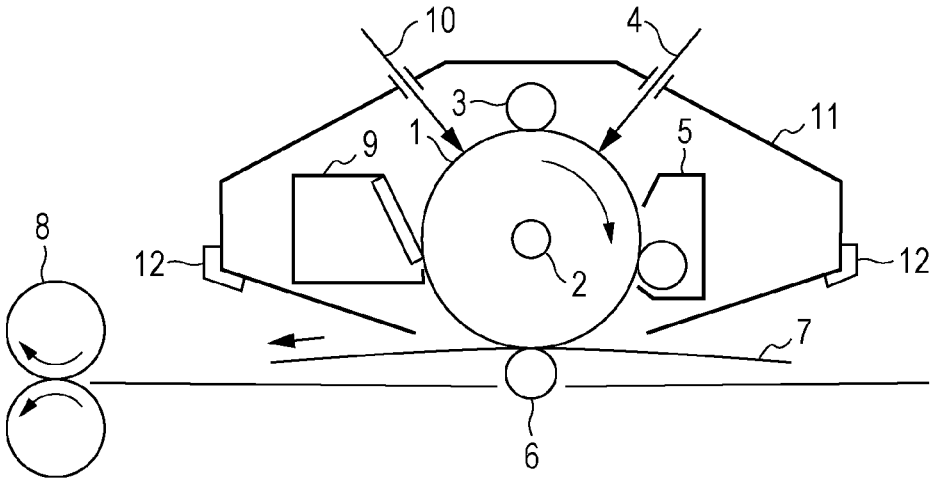
FIG. 2 is a schematic view of an electrophotographic apparatus that includes a process cartridge including an electrophotographic photosensitive member according to an embodiment of the present invention.

FIG. 2 illustrates an electrophotographic apparatus that includes a process cartridge including an electrophotographic photosensitive member according to an embodiment of the present invention.

In FIG. 2, a drum-type electrophotographic photosensitive member 1 according to an embodiment of the present invention is rotated around a shaft 2 in the direction of the arrow at a predetermined peripheral speed (process speed). During the rotation, the surface of the electrophotographic photosensitive member 1 is uniformly positively or negatively charged at a predetermined potential by a charging device (primary charging device) 3. The electrophotographic photosensitive member 1 is then irradiated with intensity-modulated exposure light 4 emitted from an exposure device (not shown), such as a slit exposure device or a laser beam scanning exposure device, in response to the time-series electric digital image signals of intended image information. In this way, electrostatic latent images corresponding to the intended image information are successively formed on the surface of the electrophotographic photosensitive member 1.

The electrostatic latent images are then subjected to normal or reversal development with a toner in a developing device 5 to be made visible as toner images. The toner images on the electrophotographic photosensitive member 1 are successively transferred to a transferring member 7 by a transferring device 6. The transferring member 7 taken from a paper feeder (not shown) in synchronism with the rotation of the electrophotographic photosensitive member 1 is fed between the electrophotographic photosensitive member 1 and the transferring device 6. A bias voltage having polarity opposite to the polarity of the electric charges of the toner is applied to the transferring device 6 with a bias power supply (not shown). The transferring device may be an intermediate transfer device that includes a primary transfer member, an intermediate transfer member, and a secondary transfer member.

The transferring member 7 is then separated from the electrophotographic photosensitive member and is transported to a fixing device 8. After the toner images are fixed, the transferring member 7 is output from the electrophotographic apparatus as an image-formed article (such as a print or a copy).

Deposits, such as residual toner, on the surface of the electrophotographic photosensitive member 1 after the toner images have been transferred are removed with a cleaning device 9. The residual toner may be recovered with the developing device 5. After the electricity is removed with pre-exposure light 10 from a pre-exposure device (not shown), the electrophotographic photosensitive member 1 is again used for image forming. In the case that the charging device 3 is a contact charging device, such as a charging roller, pre-exposure is not necessarily required.

A plurality of components selected from the electrophotographic photosensitive member 1, the charging device 3, the developing device 5, the transferring device 6, and the cleaning device 9 may be housed in a container to provide a process cartridge. The process cartridge may be detachably attached to the main body of an electrophotographic apparatus, such as a copying machine or a laser-beam printer. For example, at least one device selected from the group consisting of the charging device 3, the developing device 5, the transferring device 6, and the cleaning device 9 may be integrally supported together with the electrophotographic photosensitive member 1 to provide a process cartridge 11, which is detachably attachable to the main body of an electrophotographic apparatus through a guide unit 12, such as rails.

EXAMPLE

The present invention will be further described in the following examples and comparative examples. The term "part" in the examples means "part by mass".

Example 1

An aluminum cylinder having a diameter of 30 mm, a length of 357.5 mm, and a thickness of 1 mm was used as a support (electroconductive support).

50 parts of titanium oxide particles covered with tin oxide containing 10% antimony oxide (trade name: ECT-62, manufactured by Titan Kogyo, Ltd.), 25 parts of a resole phenolic resin (trade name: Phenolite J-325, manufactured by Dainippon Ink and Chemicals, Inc., solid content 70% by mass), 20 parts of methyl cellosolve, 5 parts of methanol, and 0.002 parts of a silicone oil (a polydimethylsiloxane-polyoxyalkylene copolymer having an average molecular weight of 3000) were dispersed for two hours with a sand mill using glass beads having a diameter of 0.8 mm to prepare an electroconductive-layer coating solution.

The electroconductive-layer coating solution was applied to the support by dip coating and was dried at 140° C. for 30 minutes to form an electroconductive layer having a thickness of 15 μm.

2.5 parts of a nylon 6-66-610-12 quaterpolymer resin (trade name: CM8000, manufactured by Toray Industries, Inc.) and 7.5 parts of an N-methoxymethylated 6 nylon resin (trade name: Toresin EF-30T, manufactured by Nagase ChemteX Corp.) were dissolved in a mixed solvent of 100 parts of methanol and 90 parts of butanol to prepare an undercoat layer coating solution.

The undercoat layer coating solution was applied to the electroconductive layer by dip coating and was dried at 100° C. for 10 minutes to form an undercoat layer having a thickness of 0.7 μm.

11 parts of hydroxy gallium phthalocyanine crystals (a charge generating substance) were prepared. The crystals had strong peaks at Bragg angles (2θ±0.2°) of 7.4° and 28.2° in CuKα characteristic X-ray diffraction. A mixture of 5 parts of a poly(vinyl butyral) resin (trade name: S-LecBX-1, manufactured by Sekisui Chemical Co., Ltd.) and 130 parts of cyclohexanone was dispersed with 500 parts of glass beads having a diameter of 1 mm at 1800 rpm for two hours while the mixture was cooled with cooling water at 18° C. After dispersion, the mixture was diluted with 300 parts of ethyl acetate and 160 parts of cyclohexanone to prepare a charge generating layer coating solution.

The average particle size (median) of the hydroxy gallium phthalocyanine crystals in the charge generating layer coating solution was 0.18 μm as measured with a centrifugal particle size analyzer (trade name: CAPA-700) manufactured by Horiba, Ltd., the principle of which is based on liquid phase sedimentation.

The charge generating layer coating solution was applied to the undercoat layer by dip coating and was dried at 110° C. for 10 minutes to form a charge generating layer having a thickness of 0.17 μm.

5 parts of a compound represented by the following formula (5) (a charge transporting substance), 5 parts of a compound represented by the following formula (6) (a charge transporting substance), and 10 parts of a polycarbonate resin (trade name: Iupilon Z400, manufactured by Mitsubishi Gas Chemical Co., Inc.) were dissolved in a mixed solvent of 70 parts of monochlorobenzene and 30 parts of dimethoxymethane to prepare a charge transporting layer coating solution.

The charge transporting layer coating solution was applied to the charge generating layer by dip coating and was dried at 100° C. for 30 minutes to form a charge transporting layer having a thickness of 18 μm.

(5)

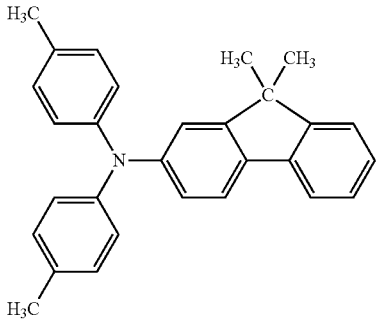

(6)

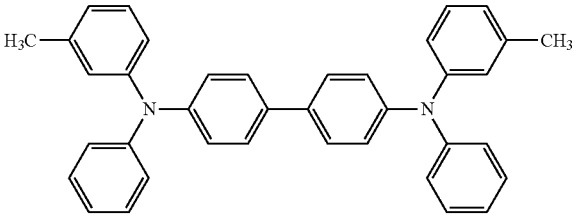

100 parts of the exemplary compound (4A-5) and 0.009 parts (90 ppm) of the exemplary compound (2-1) (compound name: p-methoxyphenol, manufactured by Tokyo Chemical Industry Co., Ltd.) were dissolved in 100 parts of n-propanol. 100 parts of 1,1,2,2,3,3,4-heptafluorocyclopentane (trade name: Zeorora H, manufactured by Zeon Corp.) was added to the solution to prepare a protective layer coating solution.

The protective layer coating solution was applied to the charge transporting layer by dip coating, and the resulting coat was heat-treated at 50° C. for five minutes. The coat was then irradiated with an electron ray for 1.6 seconds in a nitrogen atmosphere at an accelerating voltage of 70 kV and an absorbed dose of 50000 Gy. The coat was then heat-treated at 130° C. for 30 seconds in a nitrogen atmosphere. The processes from the electron ray irradiation to the 30-second heat treatment were performed at an oxygen concentration of 19 ppm. The coat was then heat-treated at 110° C. for 20 minutes in the atmosphere to form a protective layer having a thickness of 5 μm.

In this manner, an electrophotographic photosensitive member was produced. The electrophotographic photosensitive member included the support, the electroconductive layer, the undercoat layer, the charge generating layer, the charge transporting layer, and the protective layer. The protective layer was the surface layer.

Examples 2 to 10

An electrophotographic photosensitive member was produced in the same manner as in Example 1 except that the charge transporting substance having two or more methacryloyloxy groups per molecule was changed as shown in Table 1.

Examples 11 to 16

An electrophotographic photosensitive member was produced in the same manner as in Example 1 except that a protective layer coating solution was prepared by changing the charge transporting substance having two or more methacryloyloxy groups per molecule as shown in Table 1 and using the exemplary compound (1-1) (compound name: 1,4-benzoquinone, manufactured by Tokyo Chemical Industry Co., Ltd.) instead of p-methoxyphenol.

Examples 17 to 19

An electrophotographic photosensitive member was produced in the same manner as in Example 1 except that a protective layer coating solution was prepared by changing the charge transporting substance having two or more methacryloyloxy groups per molecule as shown in Table 1 and using the exemplary compound (2-3) (compound name: 2,5-bis(tert-butyl)-1,4-benzenediol, manufactured by Tokyo Chemical Industry Co., Ltd.) instead of p-methoxyphenol.

Examples 20 to 30

An electrophotographic photosensitive member was produced in the same manner as in Example 1 except that the protective layer coating solution was prepared by changing the percentage of the charge transporting substance having two or more methacryloyloxy groups per molecule and p-methoxyphenol as shown in Table 1.

Example 31

An electrophotographic photosensitive member was produced in the same manner as in Example 1 except that the protective layer coating solution was prepared by changing the charge transporting substance having two or more methacryloyloxy groups per molecule as shown in Table 1 and adding 100 parts of 1,1,2,2,3,3,4-heptafluorocyclopentane (trade name: Zeorora H, manufactured by Zeon Corp.) to 20 parts of the compound represented by the following formula (A-1) and 0.009 parts of p-methoxyphenol dissolved in 100 parts of n-propanol.

(A-1)

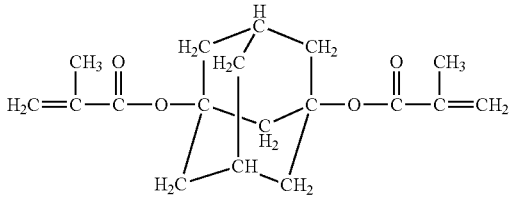

Example 32

An electrophotographic photosensitive member was produced in the same manner as in Example 1 except that the protective layer coating solution was prepared by adding 100 parts of 1,1,2,2,3,3,4-heptafluorocyclopentane (trade name: Zeorora H, manufactured by Zeon Corp.) to 80 parts of the exemplary compound (3-6), 20 parts of a compound represented by the following formula (B-1), and 0.009 parts of p-methoxyphenol dissolved in 100 parts of n-propanol.

(B-1)

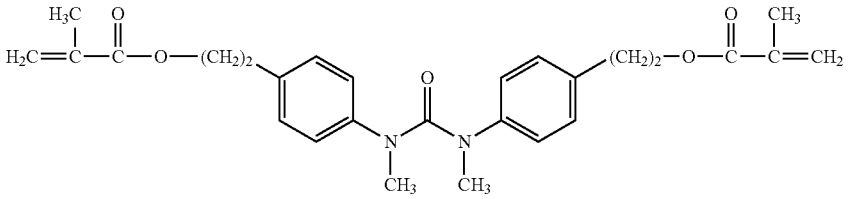

Example 33

An electrophotographic photosensitive member was produced in the same manner as in Example 31 except that the protective layer coating solution was prepared by changing the charge transporting substance having two or more methacryloyloxy groups per molecule as shown in Table 1.

Example 34

An electrophotographic photosensitive member was produced in the same manner as in Example 32 except that the protective layer coating solution was prepared by changing the charge transporting substance having two or more methacryloyloxy groups per molecule as shown in Table 1.

Example 35

An electrophotographic photosensitive member was produced in the same manner as in Example 1 except that a protective layer coating solution was prepared by changing the charge transporting substance having two or more methacryloyloxy groups per molecule as shown in Table 1 and using 90 ppm of the exemplary compound (2-4) instead of p-methoxyphenol.

Comparative Example 1

An electrophotographic photosensitive member was produced in the same manner as in Example 5 except that the protective layer coating solution was prepared without using p-methoxyphenol.

Comparative Example 2

An electrophotographic photosensitive member was produced in the same manner as in Example 6 except that the protective layer coating solution was prepared without using p-methoxyphenol.

Comparative Example 3

An electrophotographic photosensitive member was produced in the same manner as in Example 3 except that the protective layer coating solution was prepared without using p-methoxyphenol.

Comparative Example 4

An electrophotographic photosensitive member was produced in the same manner as in Example 1 except that the protective layer coating solution was prepared by using the exemplary compound (4C-1) instead of the exemplary compound (4A-5) and without using p-methoxyphenol.

Comparative Example 5

An electrophotographic photosensitive member was produced in the same manner as in Example 1 except that the protective layer coating solution was prepared by changing the charge transporting substance having two or more methacryloyloxy groups per molecule as shown in Table 1 and without using p-methoxyphenol.

Comparative Example 6

An electrophotographic photosensitive member was produced in the same manner as in Example 2 except that the protective layer coating solution was prepared without using p-methoxyphenol.

Comparative Example 7

An electrophotographic photosensitive member was produced in the same manner as in Example 1 except that the protective layer coating solution was prepared by adding 100 parts of 1,1,2,2,3,3,4-heptafluorocyclopentane (trade name: Zeorora H, manufactured by Zeon Corp.) to 100 parts of a compound G represented by the following formula (G) and 0.2 parts of p-methoxyphenol (manufactured by Tokyo Chemical Industry Co., Ltd.) dissolved in 100 parts of n-propanol.

(G)

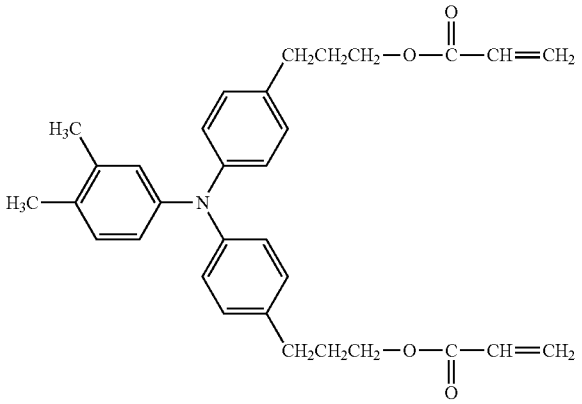

Comparative Example 8

An electrophotographic photosensitive member was produced in the same manner as in Example 1 except that the protective layer coating solution was prepared by using a compound H represented by the following formula (H) instead of the charge transporting substance having two or more methacryloyloxy groups per molecule and without using p-methoxyphenol.

(H)

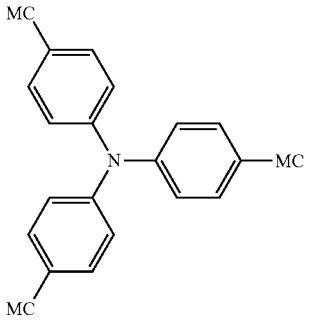

(MC)

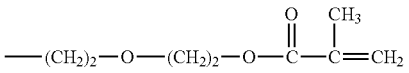

In the formula (H), MC represents a group represented by the formula (MC).

Comparative Example 9

An electrophotographic photosensitive member was produced in the same manner as in Example 1 except that a protective layer coating solution was prepared by changing the charge transporting substance having two or more methacryloyloxy groups per molecule as shown in Table 1 and using 1 part (10,000 ppm) of the exemplary compound (2-4) instead of p-methoxyphenol.

Comparative Example 10

An electrophotographic photosensitive member was produced in the same manner as in Example 1 except that the protective layer coating solution was prepared by changing the charge transporting substance having two or more methacryloyloxy groups per molecule as shown in Table 1 and using 0.2 parts (2000 ppm) of dibutylhydroxytoluene (BHT) instead of p-methoxyphenol.

Comparative Example 11

An electrophotographic photosensitive member was produced in the same manner as in Comparative Example 10 except that the protective layer coating solution was prepared by changing the BHT content as shown in Table 1 and adding 2 parts of 2,2'-azobis(2-methylpropionitrile).

Comparative Example 12

An electrophotographic photosensitive member was produced in the same manner as in Comparative Example 7 except that the protective layer coating solution was prepared using 0.01 parts of p-methoxyphenol.

Comparative Example 13

An electrophotographic photosensitive member was produced in the same manner as in Comparative Example 7 except that the protective layer coating solution was prepared using 0.01 parts of the exemplary compound (2-4) instead of p-methoxyphenol.

Comparative Example 14

An electrophotographic photosensitive member was produced in the same manner as in Comparative Example 7 except that the protective layer coating solution was prepared without using p-methoxyphenol.

TABLE 1

| | | Compounds having formulas (1) and (2) | |
|---|---|---|---|
| | CTM | Content (ppm) | Exemplary compound |
| Example 1 | 4A-5 | 90 | (2-1) |
| Example 2 | 4B-2 | 90 | (2-1) |
| Example 3 | 4C-2 | 90 | (2-1) |
| Example 4 | 4A-6 | 90 | (2-1) |
| Example 5 | 4B-3 | 90 | (2-1) |
| Example 6 | 4C-3 | 90 | (2-1) |
| Example 7 | 4A-7 | 90 | (2-1) |
| Example 8 | 4B-4 | 90 | (2-1) |
| Example 9 | 4C-4 | 90 | (2-1) |
| Example 10 | 4C-5 | 90 | (2-1) |
| Example 11 | 3A-11 | 90 | (1-1) |
| Example 12 | 3B-4 | 90 | (1-1) |
| Example 13 | 3C-1 | 90 | (1-1) |
| Example 14 | 4A-3 | 90 | (1-1) |
| Example 15 | 4B-5 | 90 | (1-1) |
| Example 16 | 4C-8 | 90 | (1-1) |
| Example 17 | 4A-1 | 90 | (2-3) |
| Example 18 | 4B-1 | 90 | (2-3) |
| Example 19 | 4C-10 | 90 | (2-3) |
| Example 20 | 3A-2 | 90 | (2-1) |
| Example 21 | 3B-5 | 90 | (2-1) |
| Example 22 | 3B-2 | 90 | (2-1) |
| Example 23 | 3B-2 | 20 | (2-1) |
| Example 24 | 3B-2 | 10 | (2-1) |
| Example 25 | 3B-2 | 5 | (2-1) |
| Example 26 | 3A-7 | 90 | (2-1) |
| Example 27 | 4A-7 | 1500 | (2-1) |
| Example 28 | 4C-6 | 90 | (2-1) |
| Example 29 | 4C-7 | 90 | (2-1) |
| Example 30 | 3B-1 | 90 | (2-1) |
| Example 31 | 3A-2 | 90 | (2-1) |
| Example 32 | 3B-2 | 90 | (2-1) |
| Example 33 | 4B-5 | 90 | (2-1) |

TABLE 1-continued

| | | Compounds having formulas (1) and (2) | |
|---|---|---|---|
| | CTM | Content (ppm) | Exemplary compound |
| Example 34 | 4B-5 | 90 | (2-1) |
| Example 35 | 4A-8 | 90 | (2-4) |
| Comparative example 1 | 4B-3 | None | — |
| Comparative example 2 | 4C-3 | None | — |
| Comparative example 3 | 4C-2 | None | — |
| Comparative example 4 | 4C-1 | None | — |
| Comparative example 5 | 4C-9 | None | — |
| Comparative example 6 | 4B-2 | None | — |
| Comparative example 7 | G | 2000 | (2-1) |
| Comparative example 8 | H | None | — |
| Comparative example 9 | 4A-8 | 10000 | (2-4) |
| Comparative example 10 | 4A-8 | 2000 | BHT(*) |
| Comparative example 11 | 4A-8 | 20000 | BHT(*) |
| Comparative example 12 | G | 100 | (2-1) |
| Comparative example 13 | G | 100 | (2-4) |
| Comparative example 14 | G | None | — |

In Table 1, "CTM" refers to a charge transporting substance, more specifically, one of the exemplary compounds described above or the compound represented by the formula (G) or (H). An asterisk following BHT indicates a comparative compound.

Evaluation

The electrophotographic photosensitive members according to Examples 1 to 34 and Comparative Examples 1 to 11 were evaluated in the following manner.

Evaluation of Memory

The memory of an electrophotographic photosensitive member was evaluated with respect to potential variation after repeated use of the electrophotographic photosensitive member. An electrophotographic photosensitive member was attached to a drum test machine CYNTHIA 59 manufactured by Gen-Tech, Inc. The initial residual potential and the residual potential after 1000 revolutions of the electrophotographic photosensitive member were measured. The surface of the electrophotographic photosensitive member was charged with a scorotron corona charger. The primary current was set at 150 μA. The grid voltage was set such that the voltage applied to the surface of the electrophotographic photosensitive member was −750 V. A halogen lamp was used as a pre-exposure light source. The wavelength of pre-exposure light was determined using a 676-nm interference filter such that the light quantity of the pre-exposure light was five times the light quantity at which the light area potential was −200 V. The rotation speed was 0.20 seconds per revolution. The evaluation was performed at a temperature of 23° C. and a humidity of 50% RH. Table 2 shows the results.

Evaluation of Spot Leakage and Image Deletion

An electrophotographic copying machine GP-405 (manufactured by CANON KABUSHIKI KAISHA) was used after modified such that a roller charger could be connected to an external power supply. The electrophotographic photosensitive member was attached to the drum cartridge, which was attached to the modified GP-405. Evaluation was performed as described below. A heater (drum heater (cassette heater)) for the electrophotographic photosensitive member was in the OFF position during the evaluation.

The surface potential of the electrophotographic photosensitive member was measured by removing a developing unit from the main body of the electrophotographic copying machine and fixing a potential measuring probe (model 6000B-8, manufactured by Trek Japan) at a position of development. A transferring unit was not in contact with the electrophotographic photosensitive member, and a paper sheet was not fed while measuring the surface potential. The charger was connected to an external power supply. The power supply was controlled with a high-voltage supply controller (Model 615-3, manufactured by Trek Inc.) at a constant voltage such that the discharge current was 500 μA. The direct-current voltage and light exposure conditions were controlled such that the electrophotographic photosensitive member had an initial dark area potential (Vd) of approximately −650 (V) and an initial light area potential (Vl) of approximately −200 (V).

The electrophotographic photosensitive member was installed in the copying machine. An image having an image ratio of 5% was printed on 100,000 pieces of A4-size portrait paper at a temperature of 30° C. and a humidity of 80% RH. The supply of electricity to the copying machine was then stopped, and the copying machine was suspended for 72 hours. After 72 hours, electricity was again supplied to the copying machine. A lattice image (4 lines, 40 spaces) and a character image (E character image) consisting of letter E's of the alphabet (font: Times, font size 6-point) were printed on A4-size portrait paper for the evaluation of image deletion. Likewise, the images were printed on an additional 100,000 pieces of paper (200,000 pieces in total) and were evaluated.

For the evaluation of spot leakage, an electrophotographic photosensitive member was installed in the copying machine. An image having an image ratio of 5% was printed on 100,000 pieces and an additional 100,000 pieces (200,000 pieces in total) of A4-size portrait paper at a temperature of 15° C. and a humidity of 10% RH. After feeding 100,000 pieces and 200,000 pieces of paper, a solid white image was printed on a piece of paper for the evaluation of spot leakage.

The printed images were rated in accordance with the following criteria. Levels A to D have the advantages of the present invention, and levels A and B are excellent. Level E lacks the advantages of the present invention. Levels 5 to 3 in the evaluation of image deletion have the advantages of the present invention. Levels 2 and 1 lack the advantages of the present invention. Table 2 shows the results.

Rating for Spot Leakage

Level A: No black spot.

Level B: Approximately one or two black spots having a diameter of 0.3 mm or less per revolution of the electrophotographic photosensitive member.

Level C: Approximately three or four black spots having a diameter of 0.3 mm or less per revolution of the electrophotographic photosensitive member.

Level D: Approximately five or six black spots having a diameter of 0.3 mm or less per revolution of the electrophotographic photosensitive member.

Level E: Seven or more black spots having a diameter of 0.3 mm or less per revolution of the electrophotographic photosensitive member.

Rating for Image Deletion

Level 5: Both the lattice image and the E character image have no image defect.

Level 4: The lattice image is partly blurred, but the E character image has no image defect.

Level 3: The lattice image is partly blurred, and the E character image is partly thin.

Level 2: The lattice image is partly lost, and the E character image is thin over the entire surface.

Level 1: The lattice image is lost over the entire surface, and the E character image is thin over the entire surface.

TABLE 2

| | | Spot leakage | | Image deletion | |
|---|---|---|---|---|---|
| | Memory | After printing on 100000 pieces of paper | After printing on 200000 pieces of paper | After printing on 100000 pieces of paper | After printing on 200000 pieces of paper |
| Example 1 | 15 | B | C | 4 | 3 |
| Example 2 | 17 | B | C | 4 | 4 |
| Example 3 | 19 | B | C | 4 | 3 |
| Example 4 | 13 | B | C | 4 | 3 |
| Example 5 | 15 | B | C | 4 | 4 |
| Example 6 | 17 | C | C | 4 | 3 |
| Example 7 | 12 | C | D | 3 | 3 |
| Example 8 | 15 | C | D | 3 | 3 |
| Example 9 | 18 | C | D | 3 | 3 |
| Example 10 | 19 | C | D | 3 | 3 |
| Example 11 | 26 | C | D | 3 | 3 |
| Example 12 | 26 | C | D | 3 | 3 |
| Example 13 | 28 | C | D | 3 | 3 |
| Example 14 | 24 | C | D | 3 | 3 |
| Example 15 | 26 | C | D | 3 | 3 |
| Example 16 | 26 | C | D | 3 | 3 |
| Example 17 | 24 | C | D | 3 | 3 |
| Example 18 | 24 | C | D | 3 | 3 |
| Example 19 | 26 | C | D | 3 | 3 |
| Example 20 | 13 | B | C | 4 | 3 |
| Example 21 | 13 | B | C | 4 | 3 |
| Example 22 | 13 | B | C | 4 | 3 |
| Example 23 | 16 | B | C | 4 | 3 |
| Example 24 | 22 | B | C | 4 | 3 |
| Example 25 | 32 | B | C | 4 | 3 |
| Example 26 | 38 | D | D | 3 | 3 |

TABLE 2-continued

| | | Spot leakage | | Image deletion | |
|---|---|---|---|---|---|
| | Memory | After printing on 100000 pieces of paper | After printing on 200000 pieces of paper | After printing on 100000 pieces of paper | After printing on 200000 pieces of paper |
| Example 27 | 27 | D | D | 3 | 3 |
| Example 28 | 6 | A | B | 5 | 4 |
| Example 29 | 6 | A | B | 5 | 4 |
| Example 30 | 6 | A | B | 4 | 4 |
| Example 31 | 11 | B | B | 4 | 4 |
| Example 32 | 11 | B | B | 4 | 4 |
| Example 33 | 18 | C | C | 4 | 3 |
| Example 34 | 18 | C | C | 4 | 3 |
| Example 35 | 26 | C | D | 3 | 3 |
| Comparative example 1 | 42 | C | D | 2 | 1 |
| Comparative example 2 | 45 | C | D | 2 | 1 |
| Comparative example 3 | 55 | C | D | 2 | 1 |
| Comparative example 4 | 50 | D | D | 1 | 1 |
| Comparative example 5 | 58 | D | D | 1 | 1 |
| Comparative example 6 | 46 | C | D | 2 | 1 |
| Comparative example 7 | 35 | E | E | 3 | 3 |
| Comparative example 8 | 42 | E | E | 2 | 1 |
| Comparative example 9 | 50 | E | E | 3 | 2 |
| Comparative example 10 | 48 | E | E | 2 | 1 |
| Comparative example 11 | 42 | E | E | 2 | 2 |
| Comparative example 12 | 30 | D | D | 3 | 2 |
| Comparative example 13 | 45 | D | E | 2 | 2 |
| Comparative example 14 | 50 | E | E | 2 | 1 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-262122 filed Nov. 30, 2011, and No. 2012-100968 filed Apr. 26, 2012, which is hereby incorporated by reference herein in its entirety.

What is claimed is:

1. An electrophotographic photosensitive member, comprising:

a support, a photosensitive layer formed on the support, wherein the electrophotographic photosensitive member comprises a surface layer comprising a polymer obtainable by the polymerization of a charge-transporting substance with two or more methacryloyloxy groups in the same molecule, wherein the surface layer further comprises a quinone derivative, the quinone derivative being at least one compound selected from the group consisting of:

a compound represented by the following formula (1), and a compound represented by the following formula (2), wherein the content of the quinone derivative in the surface layer is not less than 5 ppm and not more than 1500 ppm relative to the total mass of the polymer:

(1)

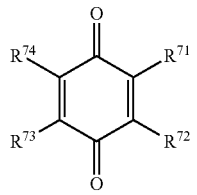

(2)

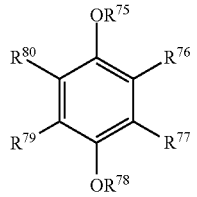

wherein, in the formulas (1) and (2), $R^{71}$ to $R^{74}$, $R^{76}$, $R^{77}$, $R^{79}$, and $R^{80}$ each independently represents a hydrogen atom, a hydroxy group, an unsubstituted or substituted alkyl group, an unsubstituted or substituted aryl group, or an unsubstituted or substituted alkoxy group, at least one of the $R^{71}$ and $R^{74}$ is a hydrogen atom, a methyl group, or a hydroxy group, at least one of the $R^{72}$ and $R^{73}$ is a hydrogen atom, a methyl group, or a hydroxy group, at least one of the $R^{76}$ and $R^{80}$ is a hydrogen atom, a methyl group, or a hydroxy group, at least one of the $R^{77}$ and $R^{79}$ is a hydrogen atom, a methyl group, or a hydroxy group, $R^{75}$ and $R^{78}$ each independently represents a hydrogen atom, an unsubstituted or substituted alkyl group, or an unsubstituted or substituted aryl group, at least one of the $R^{75}$ and $R^{78}$ is a hydrogen atom, and a substituent group of the substituted alkyl group, a substituent group of the substituted aryl group, and a substituent group the substituted alkoxy group is each independently a carboxyl group, a cyano group, a dialkylamino group, a hydroxy group, an alkyl group, an alkoxy-substituted alkyl group, a halogen-substituted alkyl group, an alkoxy group, an alkoxy-substituted alkoxy group, a halogen-substituted alkoxy group, a nitro group, a halogen atom.

2. An electrophotographic photosensitive member according to claim 1, wherein the content of the quinone derivative in the surface layer is not less than 5 ppm and not more than 100 ppm relative to the total mass of the polymer.

3. An electrophotographic photosensitive member according to claim 1, wherein, in the formula (2), $R^{75}$ is a hydrogen atom, and $R^{78}$ is an unsubstituted or substituted alkyl group, or an unsubstituted or substituted aryl group.

4. An electrophotographic photosensitive member according to claim 1, wherein the compound represented by the formula (2) is a 4-methoxyphenol.

5. An electrophotographic photosensitive member according to claim 1, wherein the charge-transporting substance is at least one compound of selected from the group consisting of a compound represented by the following formula (3) and a compound represented by the following formula (4);

(3)

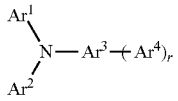

(4)

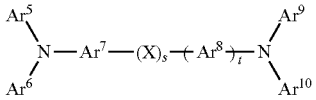

wherein, in the formulas (3) and (4), r, s, and t is each independently 0 or 1, $Ar^1$ to $Ar^2$, $Ar^3$ when r is 0 (when r is 0, there is not —$Ar^4$ and $Ar^3$ is a monovalent group), $Ar^4$ to $Ar^6$, and $Ar^9$ to $Ar^{10}$ each independently represents a group represented by the following formula (M), an unsubstituted or substituted aryl group, or an unsubstituted or substituted alkyl group, $Ar^3$ when r is 1 ($Ar^3$ is a divalent group when r is 1), and $Ar^7$ to $Ar^8$ each independently represents a group represented by the following formula (M'), an unsubstituted or substituted arylene group, at least two of the $Ar^1$ to $Ar^4$ are the group represented by the formula (M) or (M'), at least two of the $Ar^5$ to $Ar^{10}$ are the group represented by the formula (M) or (M'), X represents an oxygen atom, a cycloalkylidene group, an ethylene group, or a divalent group having two phenylene groups bonded with an oxygen atom, the aryl group is a monovalent group derived from a stilbene group by loss of one hydrogen atom, a phenyl group, a biphenylyl group, a fluorenyl group, a carbazolyl group, or a styryl group, the arylene group is a divalent group derived from a styrene group by loss of two hydrogen atoms, a phenylene group, a biphenylylene group, a fluorenediyl group, or a carbazolediyl group, and a substituent group of the substituted alkyl group, a substituent group of the substituted aryl group, a substituent group the substituted arylene group, and a substituent group of the group represented by the formula (M) or (M') is each independently a carboxyl group, a cyano group, a dialkylamino group, a hydroxy group, an alkyl group, an alkoxy-substituted alkyl group, a halogen-substituted alkyl group, an alkoxy group, an alkoxy-substituted alkoxy group, a halogen-substituted alkoxy group, a nitro group, a halogen atom; and (M)

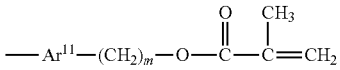

(M')

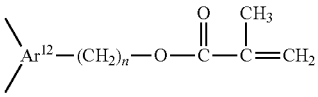

wherein, in the formula (M) and (M'), $Ar^{11}$ represents an unsubstituted or substituted arylene group, $Ar^{12}$ represents an unsubstituted or substituted trivalent aromatic group, the arylene group is a divalent group derived from a stilbene group or a styrene group by loss of two hydrogen atoms, a phenylene group, a biphenylylene group, a fluorenediyl group, a carbazolediyl group, the trivalent aromatic group is a trivalent group derived from a benzene, a biphenyl, a fluorine, a carbazole, or a styrene by loss of three hydrogen atoms, and m and n each independently represents an integer number selected from 2 to 6.

6. An electrophotographic photosensitive member according to claim 5, wherein, in the formula (M) and (M'), m and n is 3.

7. An electrophotographic photosensitive member according to claim 5, wherein, in the formula (3) and (4), at least one of the $Ar^1$ to $Ar^4$ is the group represented by the formula (M) that m is 3, or the group represented by the formula (M') that n is 3, at least one of the $Ar^1$ to $Ar^4$ is the group represented by the formula (M) that m is 2, or the group represented by the formula (M') that n is 2, at least one of $Ar^5$ to $Ar^{10}$ is the group represented by the formula (M) that m is 3, or the group represented by the formula (M') that n is 3, and at least one of the $Ar^5$ to $Ar^{10}$ is the group represented by the formula (M) that m is 2, or the group represented by the formula (M') that n is 2.

8. An electrophotographic photosensitive member according to claim 1, wherein the polymer is obtainable by the polymerization of a composition comprising:

the charge-transporting substance, and a compound represented by the following formula (A); and (A)

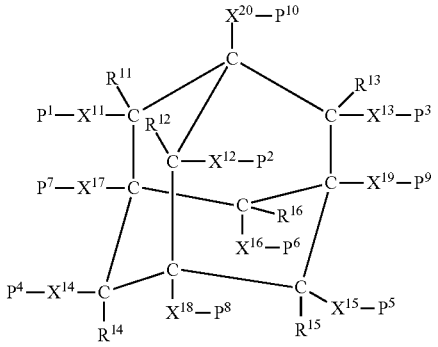

wherein, in the formula (A), $R^{11}$ to $R^{16}$ each independently represents a hydrogen atom, a methyl group, an ethyl group, a n-propyl group, a trifluoromethyl group, a hydroxy group, a methoxy group, an ethoxy group, an amino group, a dimethylamino group, a trimethylsilyl group, a fluorine atom, a chlorine atom, or a bromine atom, $X^{11}$ to $X^{20}$ each independently represents a single bond, or an alkylene group;

$P^1$ to $P^{10}$ each independently represents a hydrogen atom, a methyl group, an ethyl group, a n-propyl group, a trifluoromethyl group, a hydroxy group, a methoxy group, an ethoxy group, an amino group, a dimethylamino group, a trimethylsilyl group, a fluorine atom, a chlorine atom, a bromine atom, or a methacryloyloxy group, at least one of the $P^1$ to $P^{10}$ is the methacryloyloxy group, however, where $X^{11}$ is a single bond, $P^1$ and $R^{11}$ may combine to form an oxo group (=O), where $X^{12}$ is a single bond, $P^2$ and $R^{12}$ may combine to form an oxo group (=O), where $X^{13}$ is a single bond, $P^3$ and $R^{13}$ may combine to form an oxo group (=O), where $X^{14}$ is a single bond, $P^4$ and $R^{14}$ may combine to form an oxo group (=O), where $X^{15}$ is a single bond, $P^5$ and $R^{15}$ may combine to form an oxo group (=O), and, where $X^{16}$ is a single bond, $P^6$ and $R^{16}$ may combine to form an oxo group (=O), and, $R^{11}$ is a hydrogen atom where $P^1$ is a methacryloyloxy group, $R^{12}$ is a hydrogen atom where $P^2$ is a methacryloyloxy group, $R^{13}$ is a hydrogen atom where $P^3$ is a methacryloyloxy group, $R^{14}$ is a hydrogen atom where $P^4$ is a methacryloyloxy group, $R^{15}$ is a hydrogen atom where $P^5$ is a methacryloyloxy group, and $R^{16}$ is a hydrogen atom where $P^6$ is a methacryloyloxy group.

9. An electrophotographic photosensitive member according to claim 1, wherein the polymer is obtainable by the polymerization of a composition comprising:

the charge-transporting substance, and at least one compound selected from the group consisting of a compound represented by the following formula (B) and a compound represented by the following formula (C); and (B)

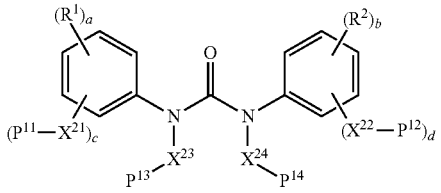

(C)

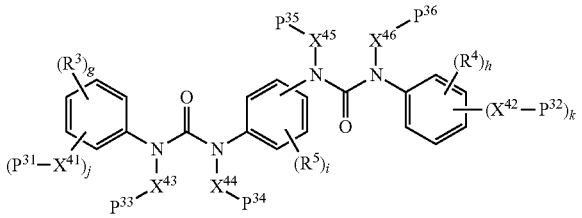

wherein, in the formulas (B) and (C), $R^1$ to $R^5$ each independently represents a methyl group, an ethyl group, a n-propyl group, a methoxymethyl group, a trifluoromethyl group, a methoxy group, an ethoxy group, a propoxy group, a methoxymethoxy group, a trifluoromethoxy group, a trichloromethoxy group, a dimethylamino group, or a fluorine atom, $X^{21}$ to $X^{24}$ and $X^{41}$ to $X^{46}$ each independently represents an alkylene group, $P^{11}$ to $P^{14}$ and $P^{31}$ to $P^{36}$ each independently represents a hydrogen atom, or a methacryloyloxy group, at least one of the $P^{11}$ to $P^{14}$ is a methacryloyloxy group, at least one of the $P^{31}$ to $P^{36}$ is a methacryloyloxy group, a, b, g, and h each independently represents an integer number selected from 0 to 5, i represents an integer number selected from 0 to 4, and c, d, j, and k each independently represents 0 or 1.

10. An electrophotographic photosensitive member according to claim 1, wherein the surface layer further comprises at least one compound selected from the group consisting of a compound represented by the following formula (D), a compound represented by the following formula (E) and a compound represented by the following formula (F); and (D)

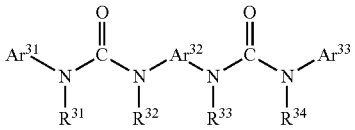

(E)

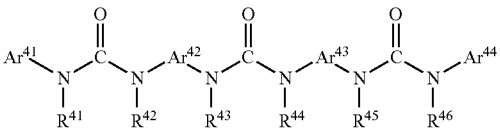

(F)

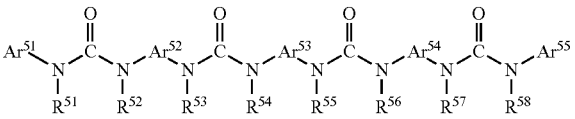

wherein, in the formulas (D), (E) and (F), $R^{31}$ to $R^{34}$, $R^{41}$ to $R^{46}$, and $R^{51}$ to $R^{58}$ each independently represents an alkyl group, $Ar^{32}$, $Ar^{42}$ to $Ar^{43}$, and $Ar^{52}$ to $Ar^{54}$ each independently represents an unsubstituted or substituted arylene group, $Ar^{31}$, $Ar^{33}$, $Ar^{41}$, $Ar^{44}$, $Ar^{51}$, and $Ar^{55}$ each independently represents an unsubstituted or substituted aryl group, or a condensed ring, a substituent group of the substituted arylene group is an alkyl group, an alkoxy-substituted alkyl group, a halogen-substituted alkyl group, an alkoxy group, an alkoxy-substituted alkoxy group, a halogen-substituted alkoxy group, or a halogen atom, and a substituent group of the substituted aryl group is a carboxyl group, a cyano group, a dialkylamino group, a hydroxy group, an alkyl group, an alkoxy-substituted alkyl group, a halogen-substituted alkyl group, an alkoxy group, an alkoxy-substituted alkoxy group, a halogen-substituted alkoxy group, a nitro group, a halogen atom.

11. An electrophotographic photosensitive member according to claim 1, wherein the surface layer does not contain a polymerization initiator.

12. A method of producing the electrophotographic photosensitive member according to claim 1, wherein the method comprises the following steps of:

forming a coat for the surface layer by the use of a surface-layer coating solution comprising the charge-transporting substance and the quinone derivative, and forming the surface layer by the polymerization of the charge-transporting substance in the coat.

13. A method of producing the electrophotographic photosensitive member according to claim 12, wherein the polymerization of the charge-transporting substance is effected by irradiating the coat with an electron beam.

14. A process cartridge detachably attachable to a main body of an electrophotographic apparatus, wherein the process cartridge integrally supports:

the electrophotographic photosensitive member according to claim 1, and at least one device selected from the group consisting of a charging device, a developing device, a transferring device, and a cleaning device.

15. An electrophotographic apparatus comprising:

the electrophotographic photosensitive member according to claim 1;

a charging device, an exposure device, a developing device, and a transferring device.

* * * * *